US012173920B2

(12) United States Patent
McLeod et al.

(10) Patent No.: US 12,173,920 B2
(45) Date of Patent: Dec. 24, 2024

(54) DUCT SUPPORT ASSEMBLY AND METHOD OF USING A DUCT SUPPORT

(71) Applicant: ACSM, Inc., Phoenix, AZ (US)

(72) Inventors: Bret Robert McLeod, Scotts Valley, CA (US); Sharad Thakorbhai Patel, Irvine, CA (US)

(73) Assignee: ACSM, Inc., Phoenix, AZ (US)

( * ) Notice: Subject to any disclaimer, the term of this patent is extended or adjusted under 35 U.S.C. 154(b) by 0 days.

(21) Appl. No.: 18/336,301

(22) Filed: Jun. 16, 2023

(65) Prior Publication Data

US 2024/0151427 A1 May 9, 2024

Related U.S. Application Data

(63) Continuation of application No. 16/989,731, filed on Aug. 10, 2020, now Pat. No. 11,719,462.

(60) Provisional application No. 62/885,506, filed on Aug. 12, 2019.

(51) Int. Cl.
*F24F 13/02* (2006.01)
*E04F 17/04* (2006.01)

(52) U.S. Cl.
CPC ..... *F24F 13/0227* (2013.01); *E04F 17/04* (2013.01); *F24F 13/0254* (2013.01)

(58) Field of Classification Search
CPC ..... F24F 13/0227; F24F 13/0254; F24F 2013/0616; F24F 2221/17; F24F 2007/0025; F24F 13/084; F24F 13/082; E04F 17/04
USPC ..... 52/220.1, 220.2, 220.8, 302.4, 302.6, 52/302.1; 454/243, 245, 270, 271, 274, 454/703, 330, 193, 183
See application file for complete search history.

(56) References Cited

U.S. PATENT DOCUMENTS 2,281,967 A * 5/1942 Zazvorka ..... E04B 2/56 52/781.5
2,318,859 A * 5/1943 Huguelet ..... H02G 5/025 174/70 B
2,878,529 A * 3/1959 Dupler ..... F24F 13/0254 174/99 R
2,935,307 A 5/1960 Goemann
3,420,560 A * 1/1969 Pfahning ..... E04B 1/2612 52/703
3,835,606 A 9/1974 Liberman
(Continued)

FOREIGN PATENT DOCUMENTS

KR 100832722 B1 5/2008

*Primary Examiner* — Brian E Glessner
*Assistant Examiner* — Adam G Barlow
(74) *Attorney, Agent, or Firm* — Knobbe, Martens, Olson & Bear, LLP

(57) ABSTRACT

Disclosed herein are embodiments of a duct support assembly. The duct support assembly can include a frame structure and a duct support. The duct support can be configured to be installed in a floor assembly between a first beam portion of a first wall frame and a second beam portion of a second wall frame and to provide a duct exit from the frame structure. The duct support can be configured to transfer a tension and/or compression load. Also disclosed herein are embodiments of a method of using a duct support to provide a duct exit from a frame structure. The method can include positioning the duct support in a floor assembly between a first beam portion of a first wall frame and a second beam portion of a second wall frame.

12 Claims, 16 Drawing Sheets

(56) References Cited

U.S. PATENT DOCUMENTS 4,237,621 A 12/1980 Boismenu
4,625,632 A * 12/1986 Markman ..... F24F 13/1486 29/890.12
4,854,376 A 8/1989 Tunekawa et al.
5,494,244 A * 2/1996 Walton ..... F24F 13/06 248/27.1
5,568,947 A * 10/1996 Paquette ..... F16L 5/00 52/220.8
5,711,091 A 1/1998 Bos
6,062,515 A * 5/2000 Snyder ..... E04C 3/02 248/62
6,111,197 A * 8/2000 Layne ..... H02G 3/12 312/265.5
6,431,979 B1 8/2002 Asbjornson et al.
6,574,932 B2 * 6/2003 Layne ..... E04F 17/04 52/220.8
8,756,888 B2 6/2014 Bowron
9,458,626 B2 * 10/2016 Hohmann, Jr. ..... E04B 1/4178
9,719,251 B2 * 8/2017 Gosling ..... E04B 1/34326
11,719,462 B2 8/2023 McLeod et al.
2002/0124495 A1 * 9/2002 Layne ..... E04F 17/04 52/302.1
2004/0020144 A1 * 2/2004 Sanders ..... E04C 3/34 52/223.7
2005/0086881 A1 * 4/2005 Greenberg ..... E02D 27/02 52/292
2005/0268450 A1 12/2005 Young
2014/0237934 A1 * 8/2014 Hohmann, Jr. ..... E04B 1/4178 52/714
2014/0250814 A1 * 9/2014 Hohmann, Jr. ..... E04G 21/142 52/379
2016/0333570 A1 * 11/2016 Gueli ..... E04B 1/2612
2016/0341442 A1 11/2016 Murray et al.
2021/0048217 A1 2/2021 McLeod et al.
2022/0316715 A1 * 10/2022 Wagner ..... B01D 45/06

* cited by examiner

DUCT SUPPORT ASSEMBLY AND METHOD OF USING A DUCT SUPPORT

INCORPORATION BY REFERENCE

Any and all applications for which a foreign or domestic priority claim is identified in the Application Data Sheet as filed with the present application are hereby incorporated by reference under 37 CFR 1.57.

The present application is a continuation of U.S. application Ser. No. 16/989,731, filed Aug. 10, 2020, which claims the benefit of U.S. Patent Application No. 62/885,506, filed Aug. 12, 2019, both of which are hereby incorporated by reference in its entirety herein.

BACKGROUND

Field

The present disclosure is generally related to duct supports and related methods.

Description of the Related Art

Duct supports are configured for supporting ducts in buildings.

SUMMARY

Disclosed herein are embodiments of a duct support configured to provide a duct exit from a frame structure of a building the duct support comprising a plurality of rigid plates forming a box shaped housing and a hole configured to receive a duct.

The duct support (e.g., a support box) can take the place of wood and be installed in many different locations (e.g., beams), including on top of a wall as part of a floor assembly.

The duct support can offer structural support for the building and desirably bear significant vertical loads and torque. For example, in some embodiments, the duct support can bear a vertical load of at least 500 lbs, at least 1000 lbs, or at least 10,000 lbs. In some embodiments, the duct support can bear a torque of at least 10 Newton-meters, at least 50 Newton-meters, at least 100 Newton-meters, at least 1,000 Newton-meters, or at least 10,000 Newton-meters.

Advantageously, the combined beam and duct support assembly can support at least 75% of the vertical load, 100% of the vertical load, 150% of the vertical load or 200% of the vertical load of a wood beam which fits within the same envelope of space. Similarly, advantageously, the combined beam and duct support assembly can resist (desirably without plastic deformation) at least 75% of the torque, 100% of the torque, 150% of the torque or 200% of the torque of a wood beam within the same envelope of space. The duct support can be used to support a duct within a building and can provide an external exit for the duct.

Also disclosed herein are embodiments of a method of using a duct support to provide a duct exit from a frame structure, the method comprising providing a duct support, putting the duct support in a beam, and placing a duct through the duct support such that the duct is supported by an inside wall and an outside wall of the duct support.

In some embodiments, the method can further comprise connecting the duct support without compromising the structural integrity of the frame structure.

Also disclosed herein are embodiments of a method of using a duct support to provide a duct exit from a frame structure, the method comprising providing a duct support and connecting the duct support to at least one beam portion to form a continuous beam.

In some embodiments, the method can further comprise placing a duct through the duct support such that the duct is supported by an inside wall and an outside wall of the duct support.

In some embodiments, the method can further comprise connecting said duct support to a first beam portion on a first side and a second beam portion on a second side.

Also disclosed herein are embodiments of a method of using a duct support, such as a support box, to provide a duct exit from a frame structure. The method can include the following steps, in no particular order:

Provide a duct support

Put the duct support in a beam

Place a duct through the duct support such that the duct is supported by the inside wall and the outside wall of the duct support Provide an external duct exit from a frame structure In some embodiments, the method can include providing a duct support that can support a duct within a building and provide a duct with an external exit from the building. The method can include putting the duct support in a beam near an exterior side of a building such that a duct can be supported by (and pass through) the duct support and exit the building through the side of the building.

In some embodiments, the method can include installing a duct support that can support a duct and provide meaningful structural support to a building. The duct support can provide support for the frame structure of a building by, for example, supporting vertical and lateral loads. The method can include removing a section of wood from a beam and replacing it with a duct support without compromising the structural integrity of the frame structure.

Also disclosed herein are embodiments of a duct support assembly comprising a frame structure comprising a floor assembly, a first wall frame, and a second wall frame, the first wall frame comprising a first beam portion and the second wall frame comprising a second beam portion, and a duct support configured to be installed in the floor assembly between the first beam portion and the second beam portion and to provide a duct exit from the frame structure, the duct support comprising a first main brace portion, a second main brace portion, a first spanning portion and a second spanning portion, each of the spanning portions extending between the first main brace portion and the second main brace portion, and an opening defining a passage configured to receive a duct, wherein the duct support is configured such that when the duct support is installed in the frame structure and a load of at least 400 lbs per square inch is applied to the second spanning portion, the duct support transfers the load to the first beam portion.

In some embodiments, each of the main brace portions can extend from the first spanning portion to the second spanning portion.

In some embodiments, the duct support can be configured to withstand the load without failing (e.g., without putting the duct support under strain that surpasses the limit of the strength of the duct support and causes the duct support to significantly reduce its load-carrying capacity).

In some embodiments, when the duct support is installed in the frame structure, the passage can allow a duct to extend through the passage to an outer wall of a building.

In some embodiments, the duct support can be configured such that compression loads applied to the second spanning portion transfer to the first spanning portion. In some embodiments, the duct support can be configured such that tension loads applied to the second spanning portion transfer to the first spanning portion.

In some embodiments, each of the first main brace portion and the second main brace portion can define a lateral portion of the duct support extending along at least 70% of a distance between a front edge of the duct support and a rear edge of the duct support.

In some embodiments, the first main brace portion can define a first planar surface and the second main brace portion can define a second planar surface. The first planar surface and the second planar surface can be coplanar.

In some embodiments, the first spanning portion can define a flange. In some embodiments, the second spanning portion can define a flange.

In some embodiments, a length of the first spanning portion can be greater than a length of the second spanning portion. In some embodiments, a length of the first spanning portion can be equal to a length of the second spanning portion.

In some embodiments, the duct support can include a plurality of stiffener sections configured to increase a load transfer capacity of the duct support. In some embodiments, the plurality of stiffener sections can include a first stiffener section coupled to an inner surface of the first main brace portion and a second stiffener section coupled to an inner surface of the second main brace portion. The first stiffener section can extend inward from a central portion of the inner surface of the first main brace portion.

In some embodiments, the plurality of stiffener sections can include a first stiffener section engaging an inner surface of the first spanning portion and an inner surface of the first main brace portion and a second stiffener section engaging an inner surface of the second spanning portion and an inner surface of the second main brace portion.

In some embodiments, the plurality of stiffener sections can include a first stiffener section engaging an inner surface of the first spanning portion and an inner surface of the second main brace portion and a second stiffener engaging an inner surface of the second spanning portion and an inner surface of the first main brace portion.

In some embodiments, the plurality of stiffener sections can include a vertical stiffener section extending between the first spanning portion and the second spanning portion. The plurality of stiffener sections can include an angled stiffener section extending between the vertical stiffener section and an inner surface of the second spanning portion.

In some embodiments, the plurality of stiffener sections can include a first stiffener section and a second stiffener section spaced apart from the first stiffener section. Each of the first and second stiffener sections can extend between the first main brace portion and the second main brace portion. Each of the stiffener sections can be disposed between the first spanning portion and the second spanning portion.

In some embodiments, the first spanning portion can include a first plate. In some embodiments, the second spanning portion can include a second plate. In some embodiments, a first plate can be coupled to an outer surface of the first spanning portion. In some embodiments, a second plate can be coupled to an outer surface of the second spanning portion. Each of the first plate and the second plate can define a flange.

In some embodiments, the first beam portion of the first wall frame can include a plurality of beams stacked vertically.

In some embodiments, the duct support can include a first connector attached to the first spanning portion. In some embodiments, the duct support can include a second connector attached to the second spanning portion. Each of the first connector and the second connector can be configured to couple to a tie rod assembly.

Also disclosed herein are embodiments of a duct support comprising a first main brace portion, a second main brace portion, a first spanning portion and a second spanning portion, each of the spanning portions extending between the first main brace portion and the second main brace portion, and an opening defining a passage configured to receive a duct, wherein the duct support is configured such that when the duct support is installed in a frame structure of a building and a load of at least 625 lbs per square inch is applied to the second spanning portion, the duct support transfers the load to the first spanning portion.

Also disclosed herein are embodiments of a method of using a duct support to provide a duct exit from a frame structure, the method comprising providing a duct support, the duct support comprising a first main brace portion, a second main brace portion, a first spanning portion, a second spanning portion, and an opening defining a passage configured to receive a duct, positioning a first wall frame of a frame structure, the first wall frame comprising a first beam portion, positioning a second wall frame of the frame structure, the second wall frame comprising a second beam portion, positioning a floor assembly of the frame structure, and installing the duct support in the frame structure, wherein when the duct support is installed in the frame structure, the duct support is positioned in the floor assembly between the first beam portion of the first wall frame and the second beam portion of the second wall frame, and wherein the duct support is configured such that when the duct support is installed in the frame structure and a load of at least 400 lbs per square inch is applied to the second spanning portion, the duct support transfers the load to the first beam portion.

In some embodiments, the method can include passing a duct through the passage of the duct support such that the duct extends to an outer wall of a building.

In some embodiments, the method can include transferring tension loads through the duct support.

In some embodiments, the method can include transferring compression loads through the duct support.

In some embodiments, installing the duct support in the frame structure can include positioning the duct support such that an outer surface of the first spanning portion of the duct support faces the first beam portion of the floor assembly. In some embodiments, installing the duct support in the frame structure can include positioning the duct support such that an outer surface of the second spanning portion of the duct support faces the second beam portion of the floor assembly.

In some embodiments, installing the duct support in the frame structure can include positioning the duct support laterally between a first joist and a second joist of a floor assembly of the frame structure.

In some embodiments, installing the duct support in the frame structure can include positioning the duct support vertically between a first portion of a post and a second portion of the post. In some embodiments, a central longitudinal axis of the post can align with a central longitudinal axis of the duct support.

In some embodiments, the method can include attaching a first end of a holdown assembly to the first portion of the post and attaching a second end of the holdown assembly opposite the first end to the second portion of the post. In some embodiments, the method can include extending a rod vertically between the first end of the holdown assembly and the second end of the holdown assembly.

In some embodiments, the method can include attaching a first portion of a tie rod assembly to a first connector attached to the first spanning portion of the duct support and attaching a second portion of the tie rod assembly to a second connector attached to the second spanning portion of the duct support.

Also disclosed herein are embodiments of a method of using a duct support to provide a duct exit from a frame structure, the method comprising providing a duct support, the duct support comprising a first main brace portion, a second main brace portion, a first spanning portion, a second spanning portion, and an opening defining a passage configured to receive a duct, and installing the duct support in a frame structure, wherein the duct support is configured such that when the duct support is installed in the frame structure and a load of at least 625 lbs per square inch is applied to the second spanning portion, the duct support transfers the load to the first spanning portion.

DETAILED DESCRIPTION

Disclosed herein are embodiments of a duct support assembly including a duct support, such as a support box, configured to provide a duct exit from a frame structure of a building. For example, the duct support can be configured to receive a duct and provide a passage for the duct to pass through to (or towards) an environment external to the building. The duct support can be installed in a portion of a frame structure of a building such that the duct support does not cause a detriment to the structural integrity of the frame structure. For example, the duct support can be configured to transfer tension and/or compression loads (such as loads that would otherwise be resisted by components of the frame structure, such as the rim of a floor assembly, in the absence of the duct support). The duct support can be configured to resist and/or transfer loads that are applied to it without deforming to a point of failure.

Also disclosed herein are embodiments of a method of using a duct support assembly. The duct support can provide options for the location of the pathway for a duct. The method of using the duct support assembly can include installing the duct support in a portion of the frame structure of the building (such as in a floor assembly of the frame structure above a first wall and below a second wall) in one of many possible locations within the frame structure (such as in a portion of the frame structure having the external-most wall frame of the frame structure).

Duct Support Assembly

Figure 1:
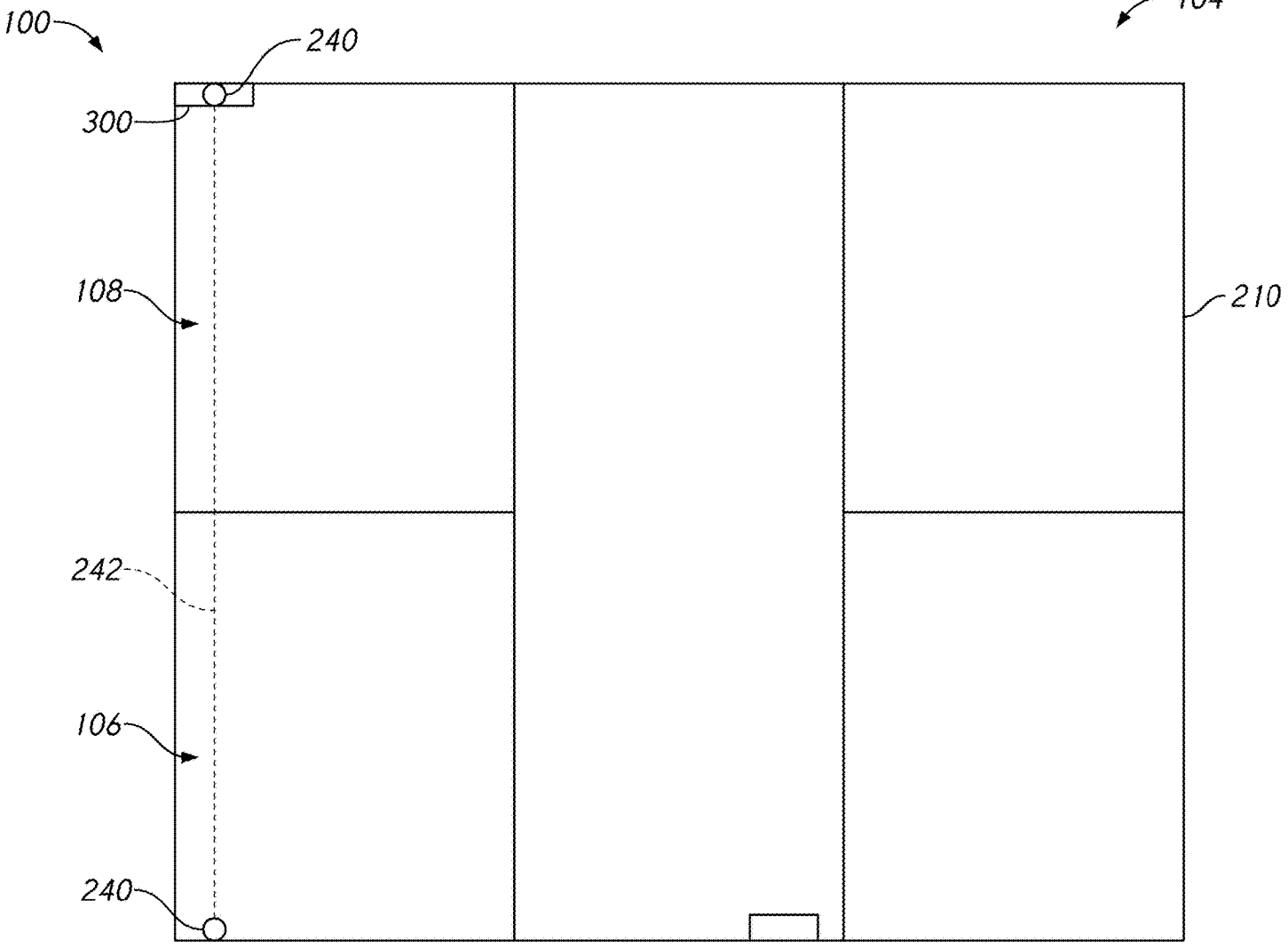
FIG. 1 is a schematic top plan view illustrating an embodiment of a duct support installed in a frame structure of a building, providing a duct with an exit from the frame structure.
Figure 2:
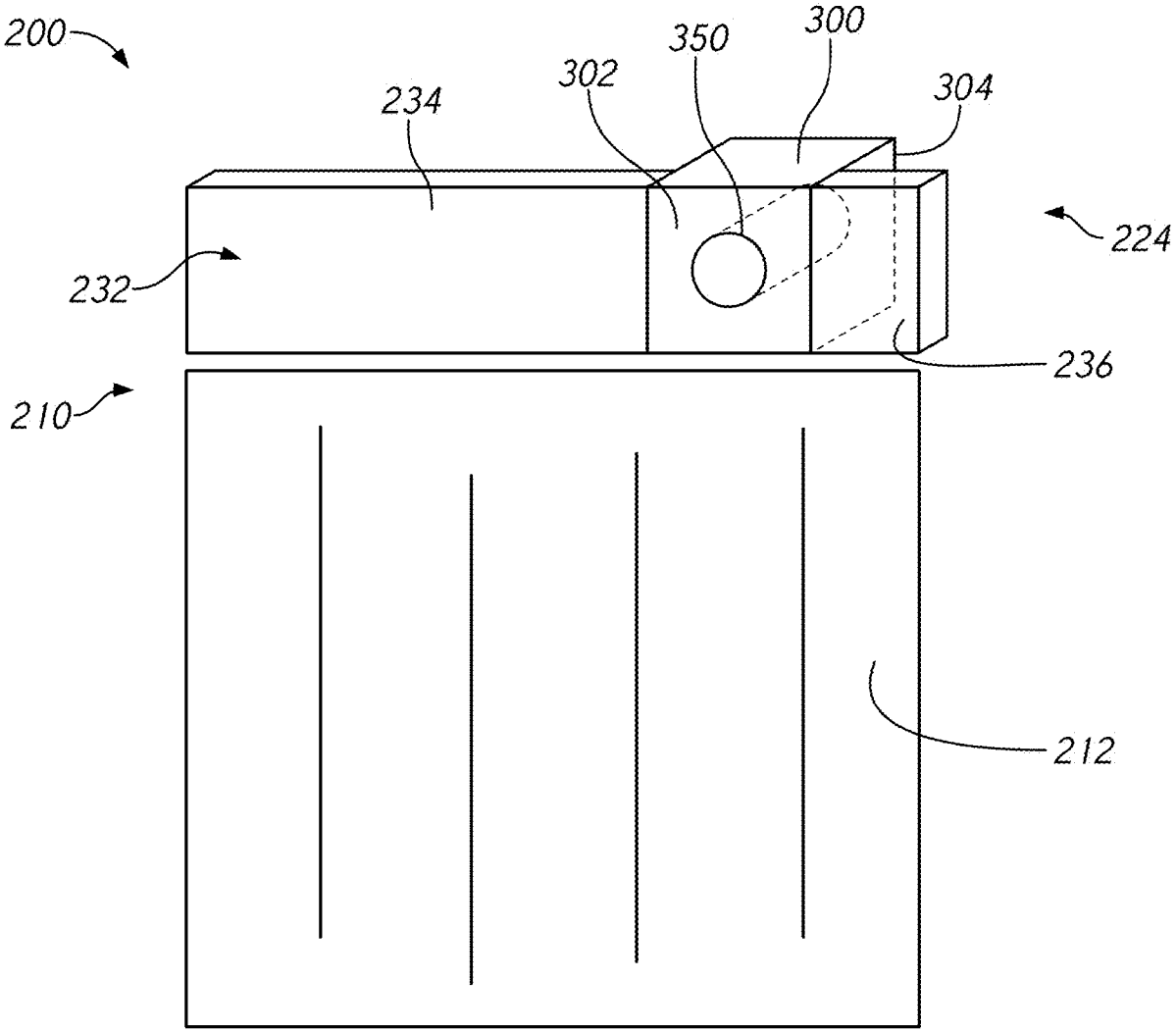
FIG. 2 is a front-right perspective view illustrating an embodiment of a duct support attached to a rim of a floor assembly above a wall frame.

FIGS. 1 and 2 schematically illustrate a duct support 300 installed in a frame structure 210 of a building 100. While the duct 240 is illustrated as visible from a top view of the duct support 300 in FIG. 1, in a preferred configuration as shown in FIG. 2 the duct 240 can pass horizontally through an opening 350 in a first face 302 (e.g., a front face) of the duct support 300 towards (or through) the opening 350 in a second face 304 (e.g., a rear face) of the duct support 300. This eliminates the need to create a vertical path through the frame structure forming exterior room 108. As shown in FIG. 1, rather than be forced to create a duct exit above a first interior room 106 (e.g., a bathroom or other room adjacent to an interior corridor 102 in a multi-story building), the duct exit can advantageously be positioned on the opposite side of the building 100 (e.g., closer to the exterior 104 of the building 100) using the duct support 300. Installing a duct support 300 in the frame structure 210 can enable a duct 240 to travel along a duct path 242 towards (and/or through) a portion of the frame structure 210 (such as a duct path 242 extending from the first interior room 106, beyond the second exterior room 108, to the exterior 104 of the building 100 as shown in FIG. 1). The strength of the duct support 300 and the ability of the duct support 300 to transfer tension and/or compression loads can facilitate such an arrangement.

FIG. 2 schematically illustrates a duct support assembly 200. The duct support assembly 200 can include a frame structure 210 and a duct support 300 configured to be installed in the frame structure 210 (such as in a floor assembly 224 of the frame structure 210). The duct support 300 can be installed in the frame structure 210, such as in the floor assembly 224 above a first wall frame 212. The duct support 300 can be aligned with the rim 232 of the floor assembly 224, between a first rim portion 234 and a second rim portion 236. A portion of the rim 232 can be removed (e.g., cut out) to provide sufficient space for the duct support 300. The first face 302 of the duct support 300 can be aligned with a first face (e.g., front face) of the rim 232. The duct support 300 can be positioned such that an upper surface of the duct support 300 (e.g., an upper surface of the second spanning portion 326) is aligned with (e.g., coplanar with) an upper surface of the rim 232 (e.g., an upper surface of the first rim portion 234 and an upper surface of the second rim portion 236). The duct support 300 can be positioned such that a lower surface of the duct support 300 (e.g., a lower surface of the first spanning portion 318) is aligned with (e.g., coplanar with) a lower surface of the rim 232 (e.g., a lower surface of the first rim portion 234 and a lower surface of the second rim portion 236). For example, a lower surface of each of the rim 232 and the duct support 300 can rest on an upper surface of the first wall frame 212.

The duct support 300 can include an opening 350 defining a passage extending from a front edge of the rim 232 towards a duct exit. The passage can be configured to receive a duct 240 and to provide a duct exit from the frame structure 210. Standard ducts are made of sheet metal. Standard ducts are made of 20 gauge to 30 gauge steel (e.g., having a thickness of 0.012-0.036"). Specialty ducts are made of 10 gauge to 18 gauge steel (e.g., having a thickness of 0.047-0.135"). Details regarding embodiments of the duct support 300 and methods of using the duct support 300 will be provided below. In general, the requirements for ducts are provided in The International Mechanical Code, but may be modified by state or other laws.

Figure 4:
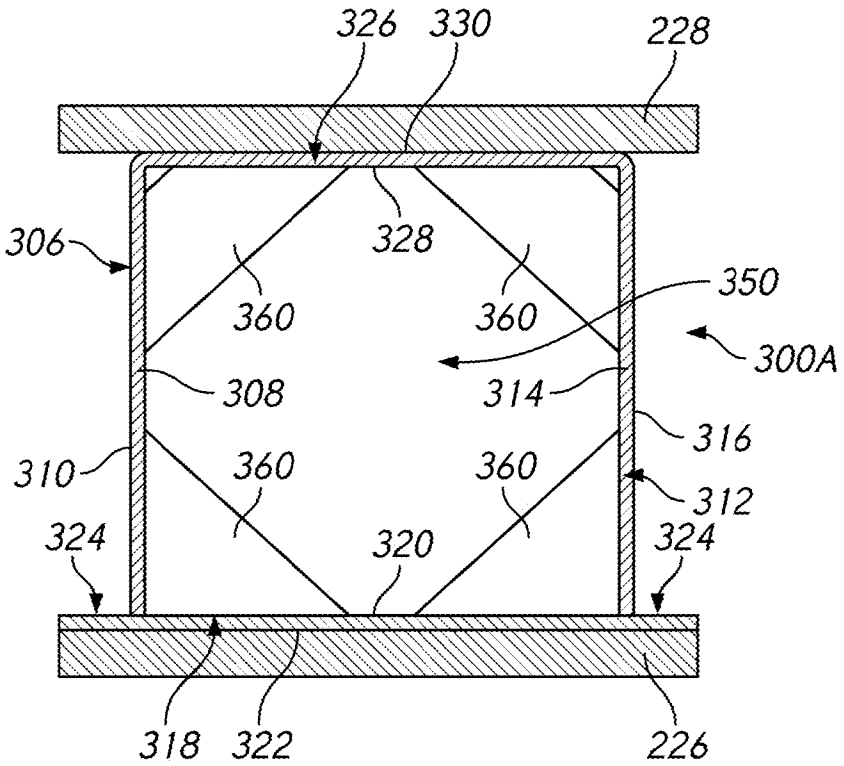
FIG. 4 is a front view of the duct support of FIG. 3 with the duct support positioned between a first beam portion and a second beam portion.
Figure 3:
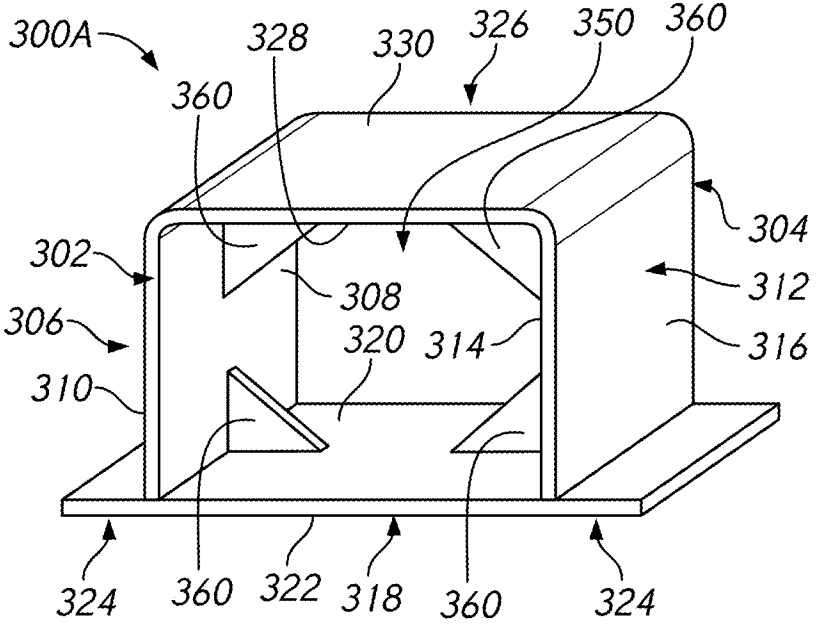
FIG. 3 is a front-right perspective view of an embodiment of a duct support.

FIGS. 3 and 4 illustrate an embodiment of a duct support 300A. The duct support 300A can include a first main brace portion 306 and a second main brace portion 312. The first main brace portion 306 can be disposed opposite (e.g., facing) the second main brace portion 312. The first main brace portion 306 can have an inner surface 308 and an outer surface 310. The second main brace portion 312 can have an inner surface 314 and an outer surface 316. The duct support 300A can include a first spanning portion 318 and a second spanning portion 326. The first spanning portion 318 can be disposed opposite (e.g., facing) the second spanning portion 326. The first spanning portion 318 can have an inner surface 320 and an outer surface 322. The second spanning portion 326 can have an inner surface 328 and an outer surface 330. The length of the first spanning portion 318 can be less than or greater than the length of the second spanning portion 326. The length of the first spanning portion 318 can be similar to or the same as the length of the second spanning portion 326.

The duct support 300A can have a first face 302 (e.g. a front face) and a second face 304 (e.g., a rear face). The first face 302 can include the exposed portions of the first and second main brace portions 306, 312 and the first and second spanning portions 318, 326 on a first side of the duct support 300A (e.g., the front side). The second face 304 can include the exposed portions of the first and second main brace portions 306, 312 and the first and second spanning portions 318, 326 on a second side (e.g., a rear side) of the duct support 300A opposite the first side.

The first and second spanning portions 318, 326 can define upper and lower portions of the duct support 300A, respectively, and the first and second main brace portions 306, 312 can define lateral portions of the duct support 300A. The first and second spanning portions 318, 326 and the first and second main brace portions 306, 312 can each be made of steel and can each have a thickness of at least ⅛", or at least ¼", or at least ⅜", or at least ½", or at least ⅝", or at least ¾", or at least ⅞", or at least 1", or at least 1.25", or at least 1.5", or at least 1.75", or at least 2". The first and second spanning portions 318, 326 and the first and second main brace portions 306, 312 can each have a thickness of 0.125-3".

The first spanning portion 318 and/or the second spanning portion 326 can extend between the first main brace portion 306 and the second main brace portion 312. The spanning portions 318, 326 can be at least 5" long, or at least 6" long, or at least 7" long, or at least 8" long, or at least 9" long, or at least 9.25" long, or at least 10" long, or at least 11" long, or at least 12" long. The spanning portions 318, 326 can be 4"-18" long. The first and second main brace portions 306, 312 can be at least can be at least 5" tall, or at least 6" tall, or at least 7" tall, or at least 8" tall, or at least 9" tall, or at least 10" tall, or at least 11" tall, or at least 12" tall.

The first spanning portion 318 can extend laterally beyond the first main brace portion 306 and/or the second main brace portion 312 and form a flange 324 on one or more sides of the duct support 300A. The flange(s) 324 can laterally extend at least 0.25", or at least 0.5", or at least 1", or at least 1.5", or at least 2", or at least 2.25", or at least 2.5", or at least 3" beyond the first main brace portion 306 and/or the second main brace portion 312. The flange(s) 324 can laterally extend between 0.25" and 5" beyond the first main brace portion 306 and/or the second main brace portion 312.

The first main brace portion 306 and/or the second main brace portion 312 can extend between the first spanning portion 318 and the second spanning portion 326. The first main brace portion 306, the second main brace portion 312, and the second spanning portion 326 can be portions of a main body having a U-shape. The main body can be formed by bending a metal plate into a U-shape. The portions of the duct support 300A at the interfaces between the main brace portions 306, 312 and the second spanning portion 326 can be curved. The radius of the curve between the first main brace portion 306 and the second spanning portion 326, and the radius of the curve between the second main brace portion 312 and the second spanning portion 326, can be relatively small (e.g., less than 3", or less than 2", or less than 1", or less than 0.5", or less than 0.25"). The main body (e.g., the first main brace portion 306 and the second main brace portion 312) can be attached to the first spanning portion 318 (e.g., by welding, using fasteners, etc.).

The duct support 300A can include one or more stiffener sections 360. The stiffener section(s) 360 can improve the ability of the second spanning portion 326 to resist bending and/or increase the load transfer capacity of the duct support 300A. For example, the inclusion of one or more stiffener sections 360 can enable the duct support 300A to transfer larger loads. The stiffener section(s) 360 can facilitate the transfer of a load from an upper portion of the duct support 300A to a lower portion of the duct support 300A and/or from a second beam portion 228 of a second wall frame 214 to a first beam portion 226 of a first wall frame 212. For example, the upper stiffener sections 360 shown in FIG. 3 can facilitate the transfer of a load from the second spanning portion 326 to the first main brace portion 306 or the second main brace portion 312. The lower stiffener sections 360 can facilitate the transfer of the load from the first main brace portion 306 or the second main brace portion 312 to the first spanning portion 318.

The duct support 300A can include at least one stiffener section 360, or at least two stiffener sections 360, or at least four stiffener sections 360, or at least eight stiffener sections 360, or at least ten stiffener sections 360, etc. The duct support 300A can include 1-16 stiffener sections 360. As shown in FIGS. 3 and 4, the shapes of the stiffener sections 360 can be triangular and/or generally triangular. In some embodiments, as illustrated in the upper stiffener sections 360 in FIG. 4, the stiffener sections 360 can be shaped to provide a gap between an edge of the stiffener section 360 and the interior interface between the first main brace portion 306 or the second main brace portion 312 and the second spanning portion 326. For example, the stiffener sections 360 can have a chamfered edge. This can advantageously allow the stiffener section 360 to fit tightly in a curved inner corner of the duct support 300A. The stiffener section 360 can have a first edge configured to engage the first spanning portion 318 or the second spanning portion 326 and a second edge configured to engage the first main brace portion 306 or the second main brace portion 312. The stiffener section 360 can be at least ⅛" thick, or at least ¼" thick, or at least ⅜" thick, or at least ½" thick. The stiffener section 360 can be 0.125"-1" thick.

The total surface area of the front faces of the stiffener sections 360 can be 4%-40%, or 15%-50%, or 30%-55%, or 25%-80% as large as the cross-sectional area (as defined by a plane perpendicular to the axis of the opening 350 and/or parallel to the first face 302) between the first main brace portion 306, the second main brace portion 312, the first spanning portion 318, and the second spanning portion 326. The total surface area of the front faces of the stiffener sections 360 can be at least 5%, or at least 10%, or at least 20%, or at least 25%, or at least 30%, or at least 40%, or at least 45%, or at least 50%, or at least 55%, or at least 60%, or at least 65%, or at least 70% as large as the cross sectional-area (defined by the vertical planes discussed above) between the first main brace portion 306, the second main brace portion 312, the first spanning portion 318, and the second spanning portion 326.

The duct support 300A can include an opening 350 configured to receive a duct. The opening 350 can define a passage for a duct to pass through. The opening 350 can be as large as the cross-sectional area (as defined by a plane perpendicular to the axis of the opening 350 and/or parallel to the first face 302) between the inner surfaces 308, 314, 320, 328 of the first main brace portion 306, second main brace portion 312, first spanning portion 318, and second spanning portion 326 (in the absence of stiffener sections 360), or the cross-sectional area remaining between the stiffener sections 360 (if included). The ratio of the overall size of the duct support 300A (including outer surfaces of the duct support 300A) to the size of the opening 350 can be about 2:1 or 1:1. The opening 350 can be at least 45%, or at least 50%, or at least 55%, or at least 60%, or at least 65%, or at least 70% or at least 75%, or at least 80%, or at least 85%, or at least 90%, or at least 95%, or at least 97.5%, or at least 99% as large as the cross-sectional area (defined by the vertical planes discussed above) between the inner surfaces 308, 314, 320, 328 of the first main brace portion 306, the second main brace portion 312, the first spanning portion 318, and the second spanning portion 326. The opening 350 can be less than 100%, or less than 95%, or less than 90%, or less than 80%, or less than 70%, or less than 60%, or less than 50%, or less than 40%, or less than 30%, as large as the cross-sectional area (defined by the vertical plane discussed above) between the inner surfaces 308, 314, 320, 328 of the first main brace portion 306, the second main brace portion 312, the first spanning portion 318, and the second spanning portion 326. The opening 350 can be 25%-100%, or 30-80%, or 90-99.5%, or 40-60%, or 60-90%, or 50-85% as large as the cross-sectional area (defined by the vertical planes discussed above) between the inner surfaces 308, 314, 320, 328 of the first main brace portion 306, the second main brace portion 312, the first spanning portion 318, and the second spanning portion 326.

As illustrated schematically in FIG. 4, the duct support 300A can be configured to be positioned between a first beam portion 226 of a first wall frame 212 and a second beam portion 228 of a second wall frame 214. The duct support 300A can be positioned such that the first beam portion 226 is disposed below the first spanning portion 318 and the second beam portion 228 is disposed above the second spanning portion 326. As shown in FIGS. 13-22, a floor sheathing panel 238 can be positioned between the second spanning portion 326 of the duct support 300 and the second beam portion 228 when the duct support 300A is installed in the frame structure 210. In some embodiments, as will be described with reference to FIG. 10, one or more spacer 374, 376 (such as a shim) can be attached to the first spanning portion 318 (e.g., surface 322 or the outer surface of a first plate 370) and/or the second spanning portion 326 (e.g., surface 330 or the outer surface of a second plate 372) to provide a tight fit for the duct support 300 within the floor assembly 224.

Figure 6:
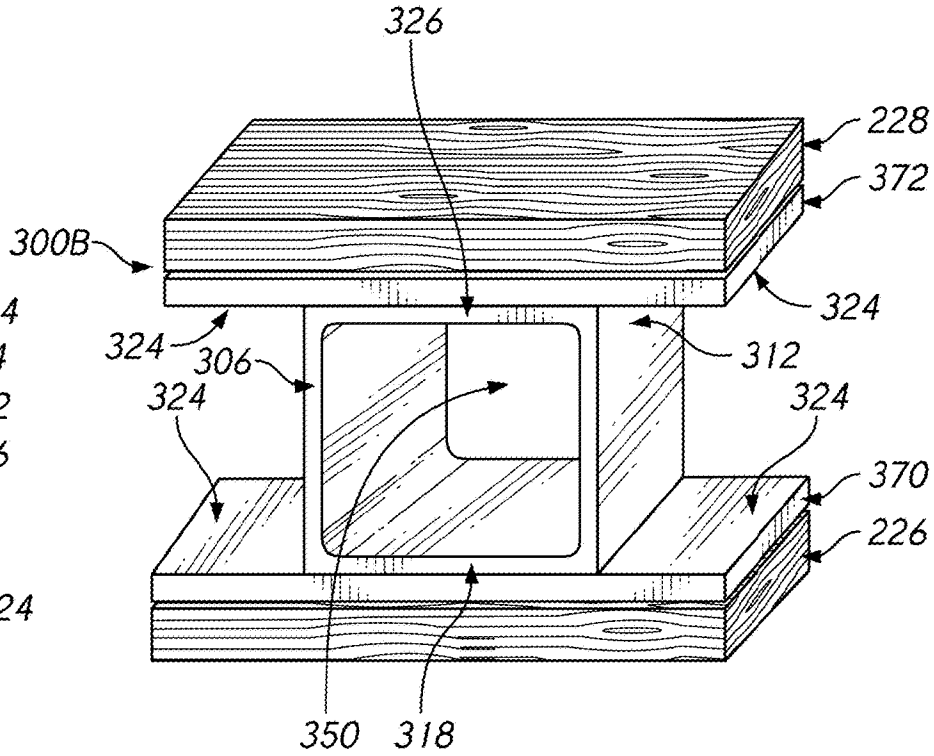
FIG. 6 is a front-right perspective view of the duct support of FIG. 5 with the duct support positioned between a first beam portion and a second beam portion.
Figure 5:
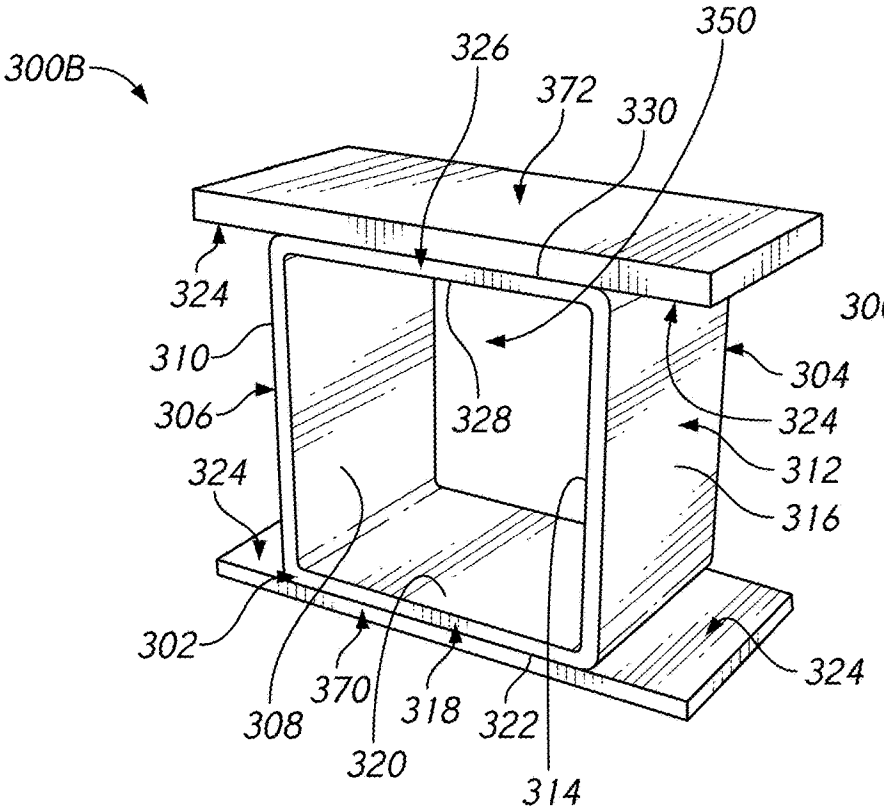
FIG. 5 is a front-right perspective view of another embodiment of a duct support.

FIGS. 5 and 6 illustrate another embodiment of a duct support 300B. The duct support 300B can have the same or similar features and/or functions as duct supports 300A, 300C, 300D, except as otherwise described. For example, the duct support 300B can include a first main brace portion 306, a second main brace portion 312, a first spanning portion 318, and a second spanning portion 326.

In some embodiments, as shown in FIGS. 5 and 6, the duct support 300B can include a first plate 370 and/or a second plate 372. The first spanning portion 318 can include the first plate 370 (e.g., by welding). The second spanning portion 326 can include the second plate 372 (e.g., by welding). In some embodiments, the first plate 370 and the first spanning portion 318 are integrally formed. In some embodiments, the second plate 372 and the second spanning portion 326 are integrally formed. The first plate 370 can extend further laterally than the main brace portions 306, 312 (e.g., the first plate 370 can define one or more flange(s) 324). The second plate 372 can extend further laterally than the main brace portions 306, 312 (e.g., the second plate 372 can define one or more flange(s) 324). The flange(s) 324 can laterally extend at least 0.25", or at least 0.5", or at least 1", or at least 1.5", or at least 2", or at least 2.25", or at least 2.5", or at least 3" beyond the first main brace portion 306 and/or the second main brace portion 312. The flange(s) 324 can laterally extend between 0.25" and 5" beyond the first main brace portion 306 and/or the second main brace portion 312.

The length of the first plate 370 can be greater than or less than the length of the second plate 372. The length of the first plate 370 can be similar to or the same as the length of the second plate 372.

The duct support 300B can be formed by cutting a Hollow Structural Section (HSS) (e.g., a 7×7 HSS steel tube, or an 8×8 HSS steel tube, or a 9×9 HSS steel tube, or a 10×10 HSS steel tube) into a shorter section. The walls of the HSS steel tube can be at least ¼" thick, or at least ⅜" thick, or at least ½" thick. The first plate 370 and/or the second plate 372 can be attached to a shortened section (e.g., a square or rectangular section) of a rectangular HSS steel tube.

As previously described, and as illustrated schematically in FIG. 6, the duct support 300B can be configured to be positioned between a first beam portion 226 of a first wall frame 212 and a second beam portion 228 of a second wall frame 214. The first plate 370 can be positioned between surface 322 and the first beam portion 226. The second plate 372 can be positioned between surface 330 and the second beam portion 228. A load applied to the duct support 300B (such a compression or a tension load) can be applied to the second plate 372. The duct support 300B can be configured to transfer the load from the second plate 372 to the first plate 370 and/or to the first beam portion 226 beneath the first plate 370.

FIGS. 7-10 illustrate another embodiment of a duct support 300C. The duct support 300C can have the same or similar features and/or functions as duct supports 300A, 300B, 300D, except as otherwise described. For example, the duct support 300C can include a first main brace portion 306, a second main brace portion 312, a first spanning portion 318, and a second spanning portion 326.

Figure 7:
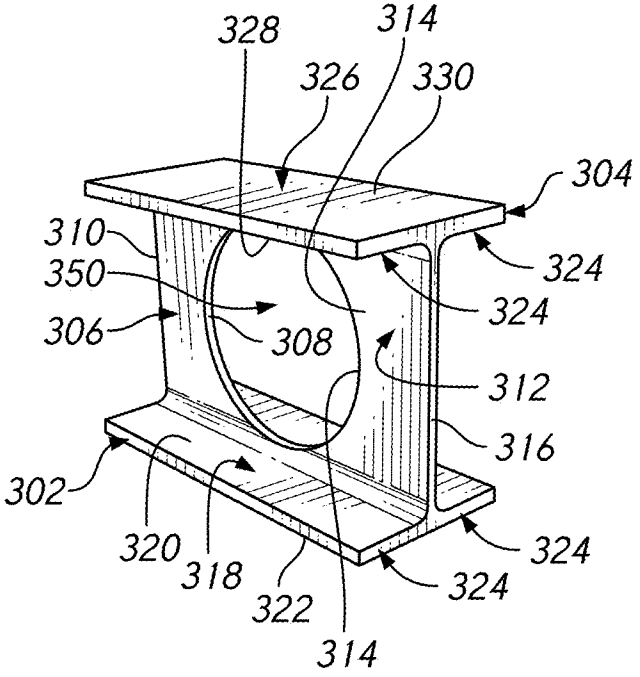
FIG. 7 is a front-right perspective view of another embodiment of a duct support.

In some embodiments, as illustrated in FIG. 7, the first main brace portion 306 can define a first planar surface and the second main brace portion 312 can define a second planar surface. The first planar surface of the first main brace portion 306 and the second planar surface of the second main brace portion 312 can be co-planar. As illustrated in FIG. 7, the first main brace portion 306 and the second main brace portion 312 can be integrally formed. As illustrated, the first main brace portion 306 and the second main brace portion 312 can define a first portion and a second portion, respectively, of a main brace. Said main brace can have a width and a length. The main brace (e.g., the first main brace portion 306 and the second main brace portion 312) can extend vertically between the first spanning portion 318 and the second spanning portion 326. The main brace can extend laterally along the centerline of the duct support 300C. The length of the main brace can span the length of the duct support 300C (e.g., the distance between a first lateral edge and a second lateral edge of the first spanning portion 318 and/or the second spanning portion 326). The main brace can be at least 1/15 as wide, or at least 1/12 as wide, or at least 1/10 as wide, or at least 1/5 as wide, or at least 1/3 as wide, or at least 1/2 as wide, as the duct support 300C.

The duct support 300C can be formed by cutting a shortened section of a wide flange beam (e.g., shortening the length of the wide flange beam). In some embodiments, the wide flange beam can be a W 8×10 beam, or a W 8×13 beam, or a W 8×15 beam, or a W 8×18 beam, or a W 8×21 beam, or a W 8×24 beam, or a W 8×28 beam, or a W 8×31 beam, or a W 8×35 beam, or a W 8×40 beam, or a W 8×48 beam, or a W 8×58 beam, or a W 8×67 beam, or a W 10×12 beam, or a W 10×15 beam, or a W 10×17 beam, or a W 10×19 beam, or a W 10×22 beam, or a W 10×26 beam, or a W 10×30 beam, or a W 10×33 beam, or a W 10×39 beam, or a W 10×45 beam, or a W 12×14 beam, or a W 12×16 beam, or a W 12×19 beam, or a W 12×22 beam, or a W 12×26 beam, or a W 12×30 beam, or a W 12×35 beam, or a W 12×40 beam, or a W 12×45 beam.

In some embodiments, as shown in FIG. 7, the opening 350 in the duct support 300C can be defined by a cut-out in the duct support 300C. For example, the opening 350 can be defined by a cut-out (such as a circular cut-out) in the center of the duct support 300C (such as a cut-out in the main brace). The cut-out (e.g., the opening 350) can have a radius of at least 1.5", or at least 2", or at least 3", or at least 3.5", or at least 4", or at least 4.5", or at least 5".

Figure 10:
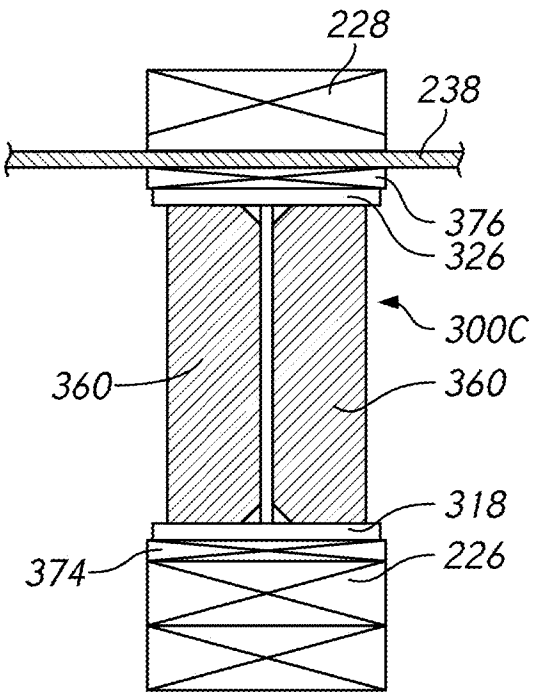
FIG. 10 is a side view of the duct support of FIG. 9 positioned between a first beam portion and a second beam portion, with a spacer, such as a shim, attached to each of the first and second spanning portions of the duct support.

The duct support 300C can include one or more stiffener sections 360. As previously described, the stiffener section(s) 360 can improve the ability of the second spanning portion 326 to resist bending and/or increase the load transfer capacity of the duct support 300C. The stiffener section(s) 360 can facilitate the transfer of a load from the second spanning portion 326 to the first spanning portion 318 and/or to the first beam portion 226 (e.g., when the duct support 300C is positioned above the first beam portion 226 as shown in FIG. 10).

Figure 8:
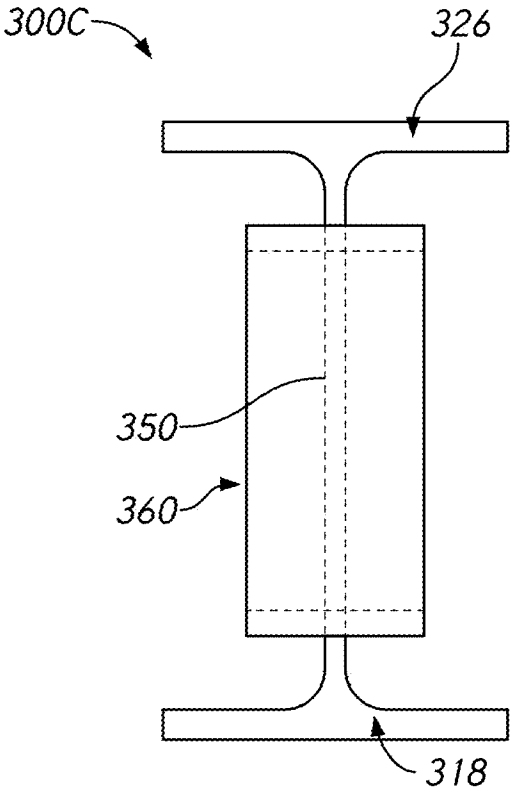
FIG. 8 is a side view of the duct support of FIG. 7 with a central stiffener section disposed in the opening of the duct support.

The stiffener section(s) 360 can be circular, rectangular, square, or another suitable shape. In some embodiments, as illustrated in FIG. 8, a stiffener section 360 can be positioned at the center of the duct support 300C. The stiffener section 360 can be a circular tube extending through the opening 350 in the duct support 300C. As illustrated in FIG. 8, the stiffener section 360 can extend forward of, rearward of, and/or laterally beyond the opening 350 (e.g., without extending beyond the first or second faces 302, 304 of the duct support 300C). For example, the stiffener section 360 can extend at least 0.5", or at least 1", or at least 1.5", or at least 2", or at least 2.25", or at least 3", or at least 3.75", or at least 4" from the opening 350 on each side of the duct support 300C. The stiffener section 360 can be at least ⅛" thick, or at least ¼" thick, or at least ⅜" thick, or at least ½" thick. The stiffener section 360 can be about 0.125"-1" thick.

Figure 9:
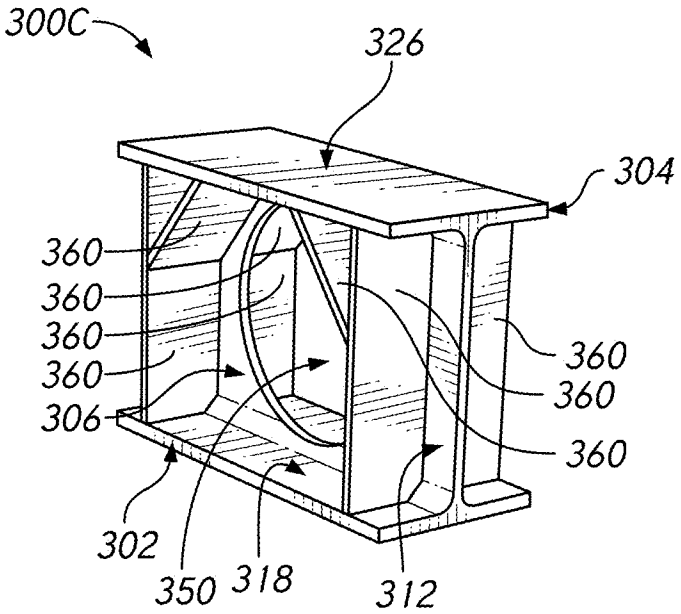
FIG. 9 is a front-right perspective view of the duct support of FIG. 7 with stiffener sections.

In some embodiments, as shown in FIG. 9, the stiffener section(s) 360 can be oriented vertically and/or diagonally. For example, the duct support 300C can include one or more vertical stiffener section(s) 360 and one or more diagonal stiffener section(s) 360. The stiffener section(s) 360 can include one or more chamfered edge(s) to improve the fit of the stiffener section 360 (as illustrated in FIG. 10). The vertical stiffener section(s) 360, such as those illustrated in FIG. 9, can facilitate the transfer of a load from the second spanning portion 326 to the first spanning portion 318. The diagonal stiffener section(s) 360, such as those illustrated in FIG. 9, can facilitate the transfer of a load from the second spanning portion 326 to the first main brace portion 306 or the second main brace portion 312.

The stiffener section(s) 360 can be connected to the first or second main brace portions 306, 312 and/or the first or second spanning portions 318, 326 (e.g., by welding, using fasteners, etc.) The stiffener section(s) 360 (e.g., vertical stiffener sections) can extend between the first spanning portion 318 and the second spanning portion 326. The stiffener section(s) 360 (e.g., diagonal stiffener sections) can extend between another stiffener section 360 (e.g., a vertical stiffener section) and the first spanning portion 318 or between another stiffener section 360 the second spanning portion 326. The stiffener section(s) 360 can be positioned on a first side of the main brace (e.g., a first side of the first main brace portion 306 and the second main brace portion 312) and/or a second side of the main brace. The stiffener section(s) 360 can extend between the main brace (e.g., the first main brace portion 306 or the second main brace portion 312) and a front edge of the duct support 300C (e.g., the first face 302). The stiffener section(s) 360 can extend between the main brace (e.g., the first main brace portion 306 or the second main brace portion 312) and a rear edge of the duct support 300C (e.g., the second face 304).

The total surface area of the faces of the stiffener sections 360 facing the first spanning portion 318 can be 2%-20%, or 15%-30%, or 10%-35%, or 25%-40% as large as the cross-sectional area (as defined by a plane perpendicular to the axis of the opening 350 and/or parallel to the first face 302) between the first main brace portion 306, the second main brace portion 312, the first spanning portion 318, and the second spanning portion 326. The total surface area of the faces of the stiffener sections 360 facing the first spanning portion 318 can be at least 1.5%, or at least 5%, or at least 10%, or at least 15%, or at least 20%, or at least 25%, or at least 30%, or at least 45% as large as the cross sectional-area (defined by the vertical planes discussed above) between the first main brace portion 306, the second main brace portion 312, the first spanning portion 318, and the second spanning portion 326.

As previously described, and as illustrated in FIG. 10, the duct support 300C can be configured to be positioned between a first beam portion 226 of a first wall frame 212 and a second beam portion 228 of a second wall frame 214. In some embodiments, as illustrated in FIG. 10, the first beam portion 226 can include more than one beam (e.g., two beams) stacked vertically. A floor sheathing panel 238 of the floor assembly 224 can be disposed between the second spanning portion 326 of the duct support 300C and the second beam portion 228.

One or more spacers 374, 376, such as a shim (e.g., plywood), can be connected to the duct support 300C to fill a gap between an upper surface of the duct support 300C and the closest member of the frame structure 210 (e.g., the floor sheathing panel 238 or second beam portion 228) and/or to fill a gap between a lower surface of the duct support 300C and the closest member of the frame structure 210 (e.g., the first beam portion 226). The spacer(s) 374, 376 can provide the duct support 300C with a tighter, more secure fit within the frame structure 210 when the size of the duct support 300C and the size of the envelope for receiving the duct support 300C are not sufficiently similar. A first spacer 374 can be attached to the first spanning portion 318 (e.g., to surface 322 or first plate 370). The first spacer 374 can be positioned above the first beam portion 226 and below the first spanning portion 318. A second spacer 376 can be attached to the second spanning portion 326 (e.g., to surface 330 or second plate 372). The second spacer 376 can be positioned above the second spanning portion 326 and below the second beam portion 228.

Figure 12:
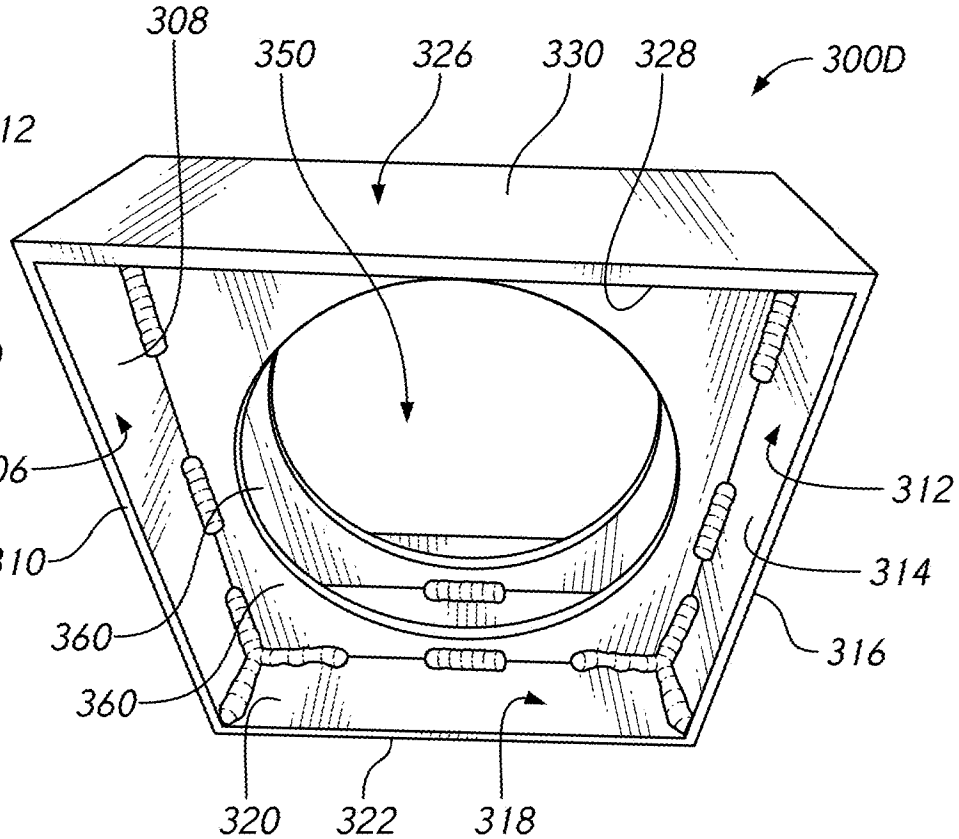
FIGS. 11-12 illustrate another embodiment of a duct support.
Figure 11:
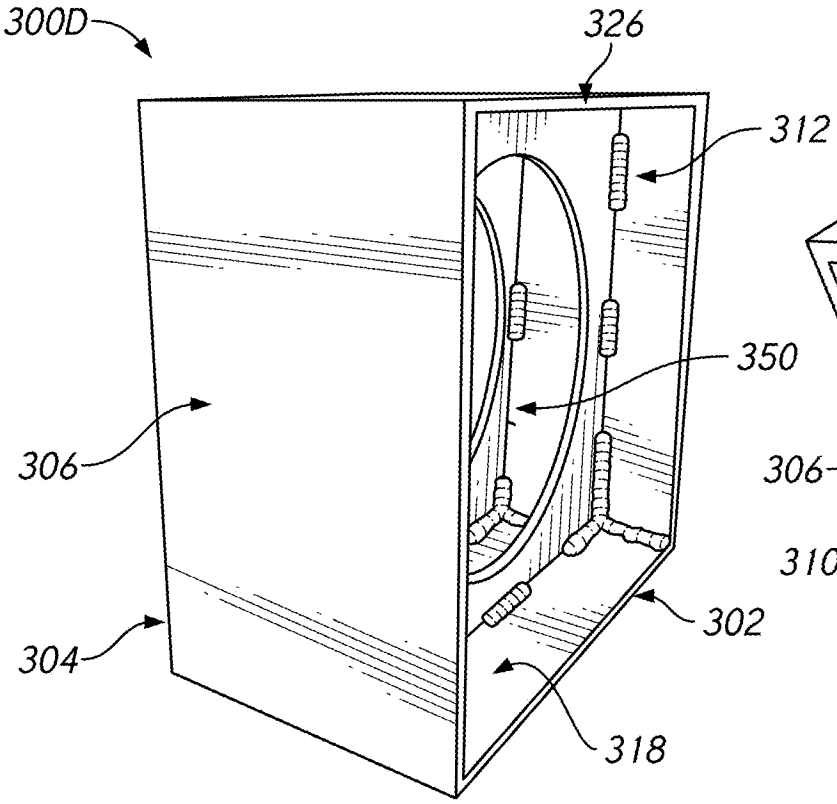

FIGS. 11 and 12 illustrate another embodiment of a duct support 300D. The duct support 300D can have the same or similar features and/or functions as duct supports 300A, 300B, 300C, except as otherwise described. For example, the duct support 300D can include a first main brace portion 306, a second main brace portion 312, a first spanning portion 318, and a second spanning portion 326.

The duct support 300D can include a plurality of stiffener sections 360. The stiffener sections 360 can be spaced apart from one another between the first face 302 and the second face 304 of the duct support 300D. The stiffener sections 360 can extend from the first spanning portion 318 to the second spanning portion 326 and from the first main brace portion 306 to the second main brace portion 312. The opening 350 in the duct support 300D can be defined by a first cut-out (e.g., a circular cut-out) in a first stiffener section 360 and second cut-out (having the same size and shape as the first cut-out) in a second stiffener section 360.

The duct support 300D can be formed by connecting a plurality of steel (e.g., A36, A572, or A500 steel) plates together (e.g., by welding, using fasteners, etc.). The steel can have a Young's Modulus of at least 25,000 Ksi or at least 27,500 Ksi, or at least 28,000 Ksi, or at least 29,500 Ksi, or at least 30,000 Ksi, or at least 32,500 Ksi. The steel can have a Young's Modulus of about 20,000 Ksi to about 35,000 Ksi. The steel can have a Poisson's Ratio of at least 0.2, or at least 0.22, or at least 0.24, or at least 0.26, or at least 0.28, or at least 0.3, or at least 0.3, or at least 0.33. The steel can have a Poisson's Ratio of about 0.2 to about 0.34.

Various aspects of the duct support 300 can be modified to accommodate different frame structures 210 with different floor assemblies 224 and loading conditions. For example, the height of the duct support 300 can be configured to fit the particular floor assembly 224. The thickness of the steel and/or the welding used to form the duct support 300 can be configured to accommodate the particular loading conditions in the location where the duct support 300 will be installed (e.g., the steel can be thinner when the loading conditions are less demanding and thicker when the loading conditions are more demanding). The materials used, such as the type of steel (e.g., A36, A572, A500), can be configured to accommodate the floor assembly 224 and loading conditions.

Figure 19:
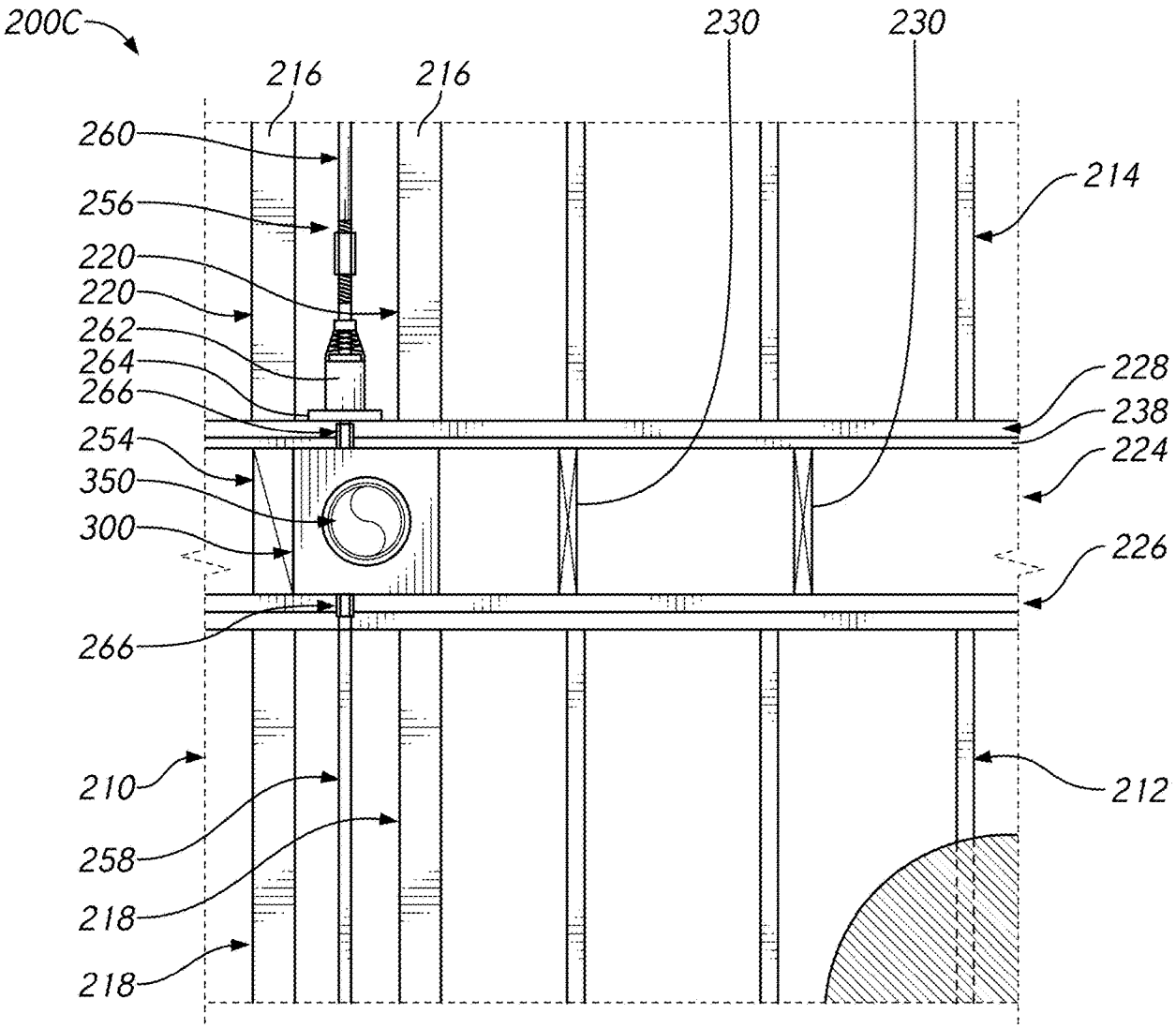
FIG. 19 illustrates a method of installing a duct support in a frame structure using a continuous tie rod assembly, where the duct support is configured to transfer a tension or compression load. The rim of the floor assembly is omitted in order to show other components of the frame structure.
Figure 21:
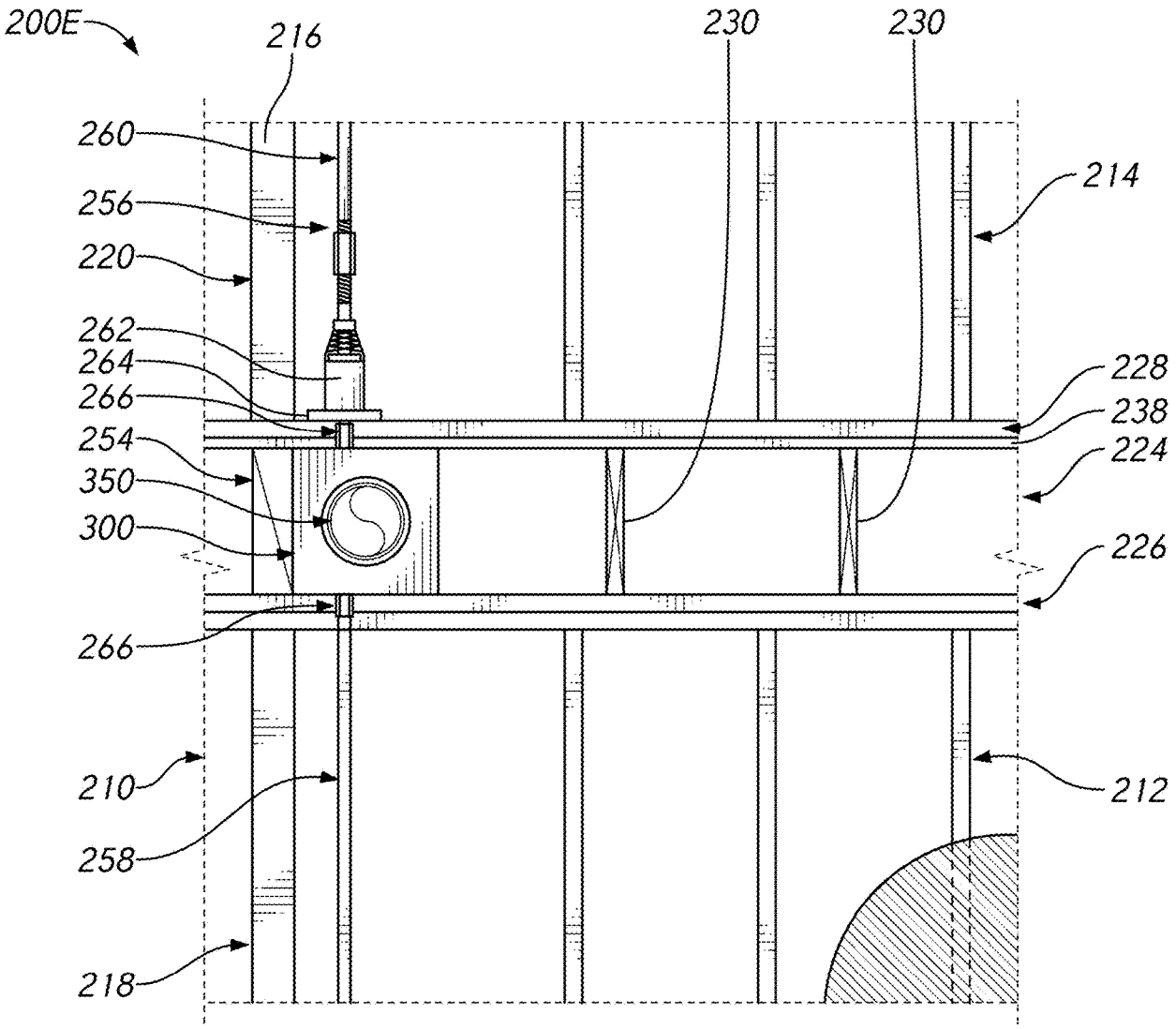
FIG. 21 illustrates a method of installing a duct support in a frame structure using a continuous tie rod assembly, where the duct support is configured to transfer a tension load. The rim of the floor assembly is omitted in order to show other components of the frame structure.
Figure 22:
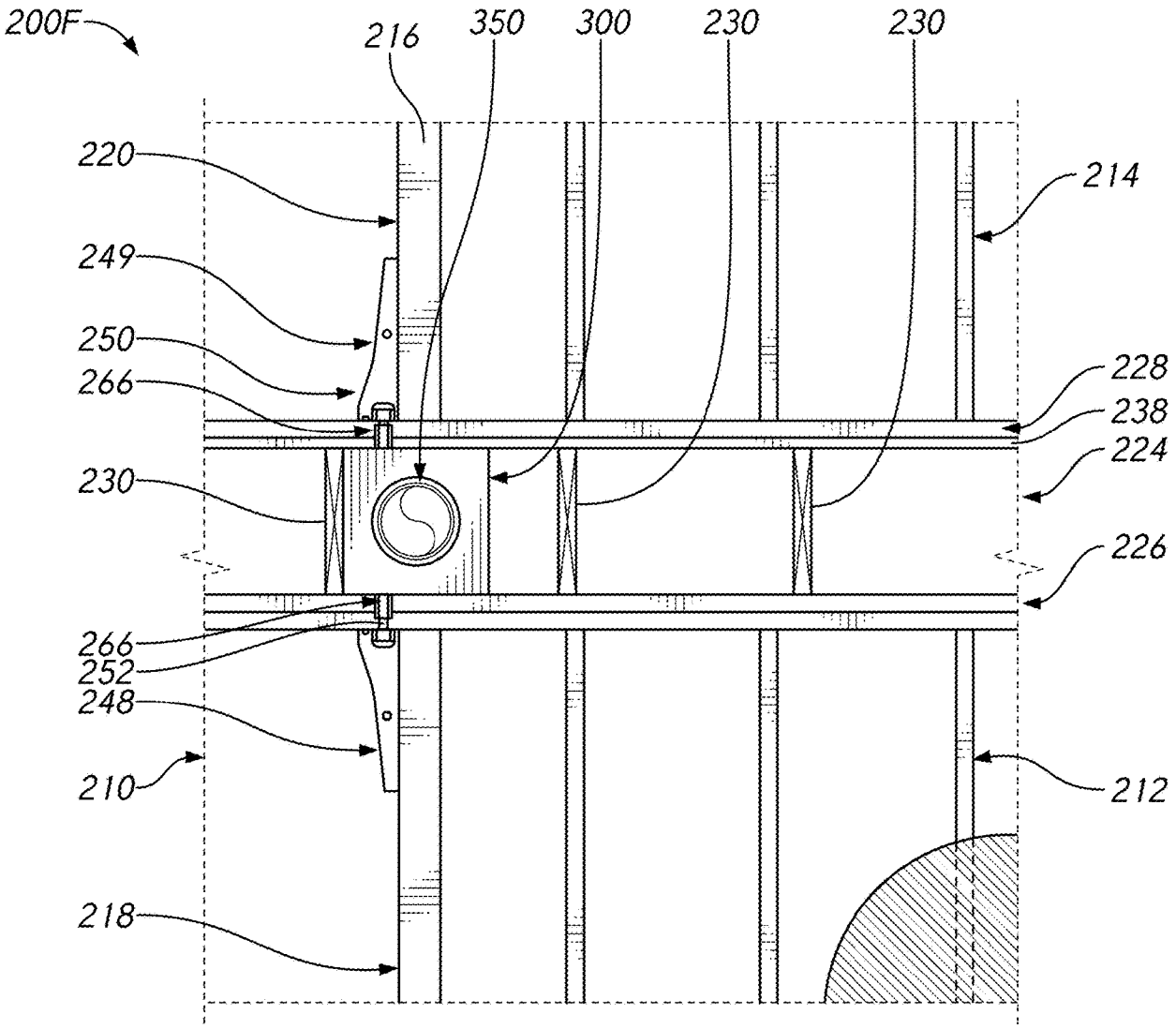
FIG. 22 illustrates a method of installing a duct support in a frame structure using a holdown assembly, where the duct support is configured to transfer a tension or compression load. The rim of the floor assembly is omitted in order to show other components of the frame structure.

In some embodiments, such as the embodiments shown in FIGS. 19, 21, and 22, connectors 266, such as coupler nuts, can be welded to upper and/or lower portions of the duct support 300 and be configured to receive threaded rods or tension ties. Such a configuration can enable the duct support 300 to transfer tension loads vertically while also allowing a duct to pass through the frame structure 210 at the location in which the duct support 300 is installed in the frame structure 210.

Figure 13:
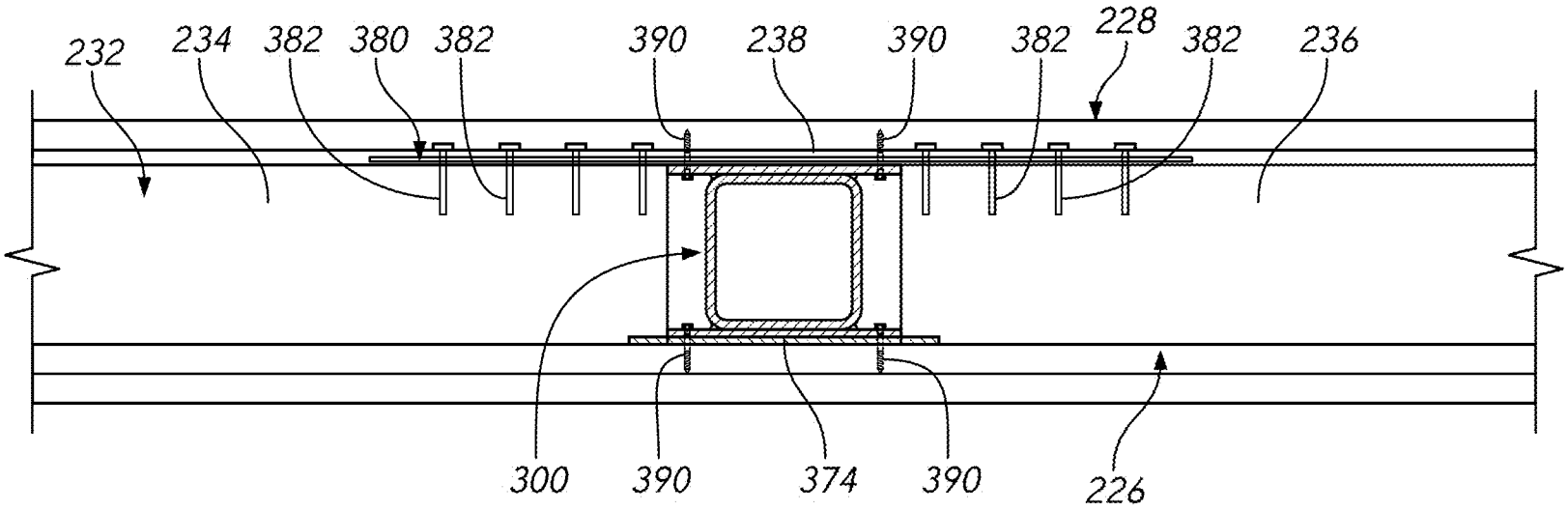
FIG. 13 is a front view of a duct support positioned laterally between a first rim portion and a second rim portion of a floor assembly and vertically between a first beam portion of a first wall frame and a second beam portion of a second wall frame, with a strap securing the duct support in position relative to the first and second rim portions.
Figure 14:
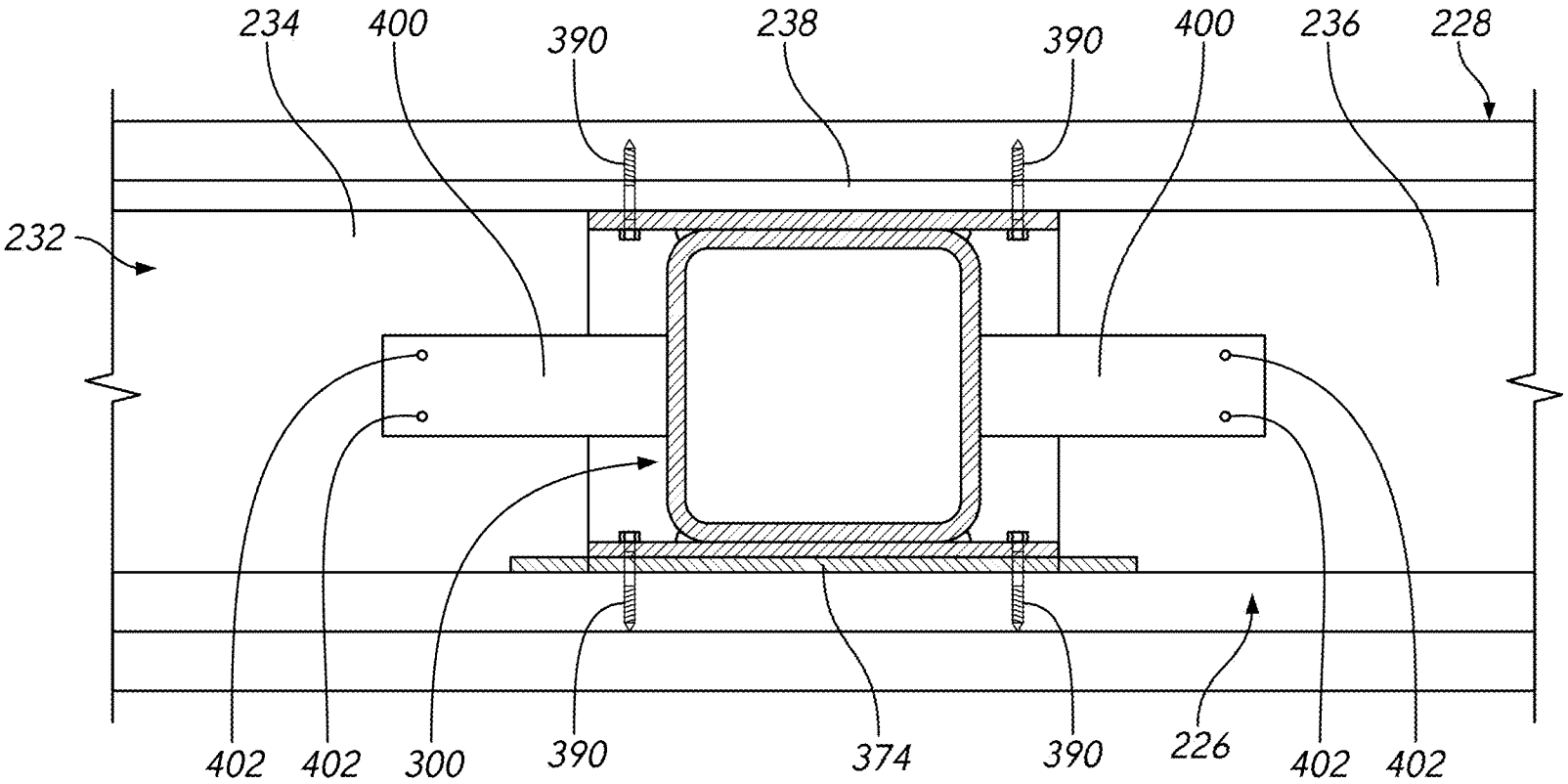
FIG. 14 is a front view of a duct support positioned laterally between a first rim portion and a second rim portion of a floor assembly and vertically between a first beam portion of a first wall frame and a second beam portion of a second wall frame, with a plurality of plates connecting the duct support to the first and second rim portions.

In some embodiments, such as the embodiments shown in FIGS. 13 and 14, a plurality of holes are formed in portions of the duct support 300 (e.g., along the top, bottom, and/or sides of the duct support 300). The holes can be configured to receive fasteners such that the duct support 300 can be easily attached to adjacent framing members of the frame structure 210.

In some embodiments, such as the embodiments shown in FIGS. 10, 13, and 14, wood nailers or shims can be pre-installed in the duct support 300 (e.g., attached to or integrated into the top, bottom, and/or sides of the duct support 300) to facilitate incorporation of the duct support 300 into the frame structure 210 of the building. Said wood nailers or shims can make it easier to attach the duct support 300 to wood elements in the frame structure 210 and/or can enable the duct support 300 to accommodate different frame structure depths.

In some embodiments, such as the embodiment shown in FIGS. 3 and 4, one or more stiffener sections 360 are included in, or attached to, the duct support 300 to increase the strength of the duct support 300. Reducing the number of stiffener sections 360, or omitting stiffener sections 360, in the duct support 300 can reduce the strength of the duct support 300 (which can desirably increase the efficiency and/or reduce the manufacturing cost of the duct support 300 when loading conditions are less demanding).

In some embodiments, the length of the duct support 300 (e.g., the length of the spanning portions 318, 326 of the duct support 300) can be configured to accommodate different sizes or styles of ducts (e.g., rectilinear ducts).

In some embodiments, finish is applied to the duct support 300. In some embodiments, no finish is applied to the duct support 300.

Method of Using a Duct Support to Provide a Duct Exit from a Frame Structure

The method of using the duct support 300 to provide a duct exit from a frame structure 210 can include any of the steps outlined below, in any order.

The method can include providing a duct support 300 having a first main brace portion 306, a second main brace portion 312, a first spanning portion 318, a second spanning portion 326, and an opening 350 defining a passage configured to receive a duct.

The method can include positioning a first wall frame 212 of the frame structure, including a first beam portion 226. The method can include positioning a second wall frame 214 of the frame structure 210, including a second beam portion 228.

The method can include positioning a floor assembly 224 of the frame structure 210. The floor assembly 224 can include a floor sheathing panel 238, a rim 232, and a plurality of joists 230. The method can include removing (e.g., cutting out) a section of the rim 232 to create space to accommodate the duct support 300, thereby providing a gap between a first rim portion 234 on a first lateral side of the space and a second rim portion 236 on a second lateral side of the space.

FIG. 13 illustrates a method of installing a duct support 300 in the frame structure 210 between the first beam portion 226 of the first wall frame 212 and the second beam portion 228 of the second wall frame 214 (e.g., above the first beam portion 226 and below the second beam portion 228). The method can include positioning the duct support 300 in the floor assembly 224, laterally between the first rim portion 234 and the second rim portion 236. The method can include securing the duct support 300 to the first beam portion 226 and the second beam portion 228 using a plurality of connectors 390 (such as screws, bolts, etc.). The method can include extending connectors 390 downward through a portion of the duct support 300 (e.g., through the first spanning portion 318 and/or a first spacer 374) and into the first beam portion 226. The method can include extending connectors 390 upward through a portion of the duct support 300 (e.g., through the second spanning portion 326 and/or a second spacer 376) and into the floor sheathing panel 238 of the floor assembly 224 and/or the second beam portion 228.

As shown in FIG. 13, the method can include securing the duct support 300 in position relative to the rim 232 using a strap 380 (such as a coiled strap). The strap 380 can include holes for receiving fasteners. The method can include cutting the strap 380 to a desired length and extending it horizontally over a portion of the first rim portion 234, the duct support 300, and a portion of the second rim portion 236. The method can include inserting fasteners 382 (such as nails) downward through the strap 380 (e.g., through holes in the strap 380) into the first rim portion 234 and the second rim portion 236. The strap 380 may be manufactured from a material such as steel (e.g., sheet metal). The strap 380 can be made of 20 gauge to 14 gauge steel. The strap 380 can have a thickness of about 0.03-0.25 inches. The strap 380 can have a thickness of at least 0.02", or at least 0.05", or at least 0.1" or at least 0.15", or at least 0.2", or at least 0.25". The strap 380 can have a width of about 1.5" to 7.25". The strap 380 can have a width of at least 0.5", or at least 1", or at least 1.5", or at least 2", or at least 3.5", or at least 5", or at least 7", or at least 7.5". The width of the strap 380 can be varied based on the depth of the wall frame 212, 214 (e.g., the wall frame 212, 214 can have a depth of about 3-8", or a depth of at least 3", or at least 4", or at least 6", or at least 8"). The strap 380 can have a length of about 10" to 100". The strap 380 can extend about 5" to 50" to the left and right of the center of the strap 380. The strap 380 can have a length of at least 3", or at least 6", or at least 10", or at least 25", or at least 50", or at least 65", or at least 80", or at least 95".

FIG. 14 illustrates a method of connecting the duct support 300 to the first rim portion 234 and the second rim portion 236. The method can include attaching a plurality of plates 400 to lateral portion of the duct support 300. A first plate 400 can be attached to (e.g., welded to) the first face 302 of the duct support 300 (e.g., a face of the first main brace portion 306, a face of the first or second spanning portion 318, 326, and/or a face of a stiffener section 360) such that the first plate 400 extends laterally away from the duct support 300 towards the first rim portion 234. A second plate 400 can be attached to (e.g., welded to) the first face 302 of the duct support 300 (e.g., a face of the second main brace portion 312, a face of the first or second spanning portion 318, 326, and/or a face of a stiffener section 360) such that the second plate 400 extends laterally away from the duct support 300 towards the second rim portion 236. The plates 400 can each include one or more apertures 402 configured to receive fasteners (such as screws, bolts, etc.). The method can include inserting fasteners through the apertures 402 in the plates 400 and into the first and second rim portions 234, 236.

In some embodiments, the method can include assembling portions of the duct support assembly 200 prior to shipping the components to a construction site. For example, in some embodiments, the method can include connecting the duct support 300 to a portion of the first wall frame 212 or to a portion of the second wall frame 214 prior to shipping the components. In some embodiments, the method can include connecting the duct support 300 to a portion of the floor assembly 224 prior to shipping the components.

Figure 16:
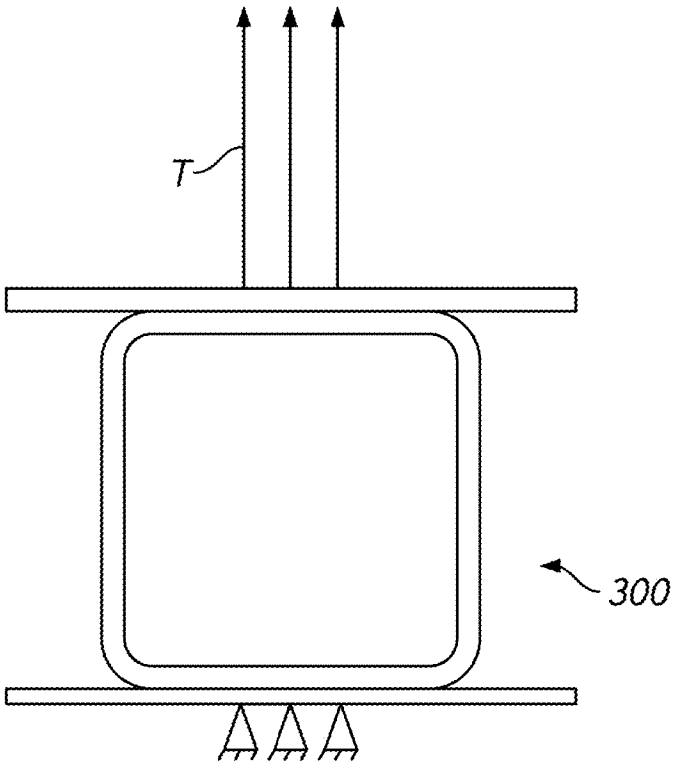
FIG. 16 illustrates a tension load applied to a duct support.
Figure 15:
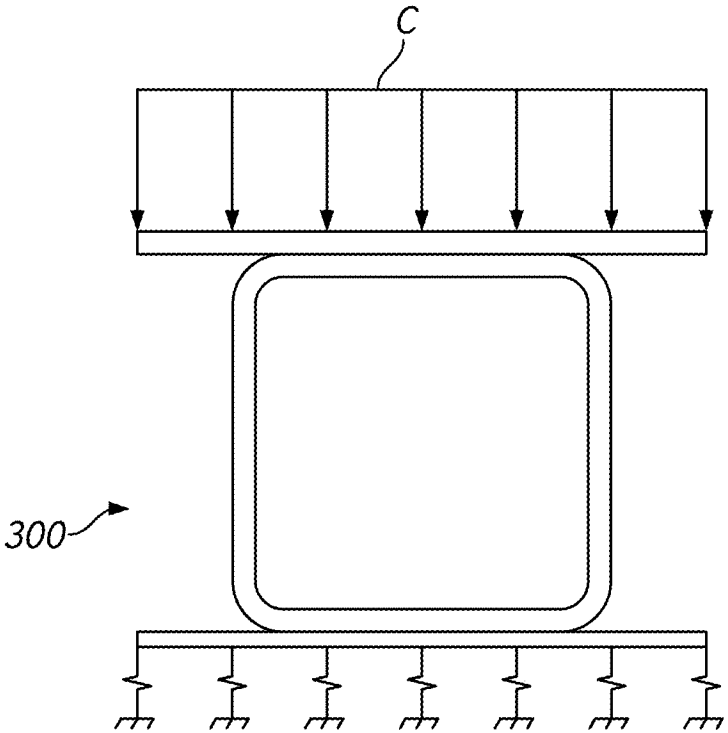
FIG. 15 illustrates a compression load applied to a duct support.

The method can include transferring a load, such a compression load or a tension load, through the duct support 300. FIG. 15 illustrates a compression load C applied to an upper portion of the duct support 300. The compression load C can be applied to the outer surface of the second spanning portion 326 (e.g., surface 330 or an outer surface of a second plate 372) and/or an outer surface of a second spacer 376. FIG. 16 illustrates a tension load T applied to an upper portion of the duct support 300. The tension load T can be applied to at least a portion of the outer surface of the second spanning portion 326 (e.g., surface 330 or an outer surface of a second plate 372) and/or an outer surface of a second spacer 376. As previously described, the method can include transferring a load from the second spanning portion 326 (or second spacer 376) to the first spanning portion 318 and/or to the first beam portion 226 disposed beneath the first spanning portion 318.

The duct support 300 can be configured such that when the duct support 300 is installed in the frame structure 210 (e.g., in the floor assembly 224) and a load (e.g., a compression or tension load) of at least 625 psi is applied to the second spanning portion 326 (or second spacer 376), the duct support 300 transfers the load to the first spanning portion 318 and/or the first beam portion 226.

The duct support 300 can be configured to transfer a compression load C of at least 300 psi, or at least 400 psi, or at least 550 psi, or at least 600 psi, or at least 625 psi, or at least 700 psi, or at least 850 psi, or at least 925 psi, or at least 1000 psi, or at least 1250 psi, or at least 1500 psi, from an upper portion of the duct support 300 to a lower portion of the duct support 300 and/or to the first beam portion 226 positioned below the duct support 300. The duct support 300 can be configured to transfer a compression load C of about 100 psi-2000 psi.

As shown in FIGS. 15-16, the tension load T may be applied to a smaller surface area of the duct support 300 than the compression load C. Desirably, the duct support 300 can be configured to transfer a tension load T of at least 2000 psi, or at least 2500 psi, or at least 3000 psi, or at least 3250 psi, or at least 3500 psi, or at least 3800 psi, or at least 4000 psi, or at least 4400 psi, or at least 4600 psi, or at least 4800 psi, or at least 5000 psi, from an upper portion of the duct support 300 to a lower portion of the duct support 300 and/or to the first beam portion 226 positioned below the duct support 300. The duct support 300 can be configured to transfer a tension load T of about 500 psi-6000 psi.

The duct support 300 can be configured to transfer a load (in compression and/or tension) of at least 20 kips, or at least 25 kips, or at least 30 kips, or at least 35 kips, or at least 40 kips, or at least 45 kips, or at least 50 kips, or at least 55 kips, or at least 60 kips, from the second beam portion 228 to the first beam portion 226. The duct support 300 can be configured to transfer a load of about 50 lbs-50,000 lbs. For example, the duct support can be configured to transfer a load of at least 50 lbs, or at least 100 lbs, or at least 250 lbs, or at least 500 lbs, or at least 750 lbs, or at least 1,000 lbs, or at least 2,500 lbs, or at least 5,000 lbs, or at least 10,000 lbs, or at least 15,000 lbs, or at least 25,000 lbs, or at least 30,000 lbs, or at least 35,000 lbs, or at least 37,500 lbs, or at least 40,000 lbs, or at least 42,500 lbs, or at least 45,000 lbs, or at least 50,000 lbs.

The duct support 300 can be configured to transfer the above-mentioned loads from the second beam portion 228 to the first beam portion 226 without failing (e.g., without putting the duct support 300 under strain that surpasses the limit of the strength of the duct support 300 and causes the duct support 300 to significantly reduce its load-carrying capacity).

FIGS. 17-22 illustrate embodiments of a method of assembling a frame structure 210 to accommodate a duct support 300. The rim 232 of the floor assembly 224 has been omitted in FIGS. 17-22 to show the relationship between the duct support 300 and other portions of the frame structure 210.

Figure 17:
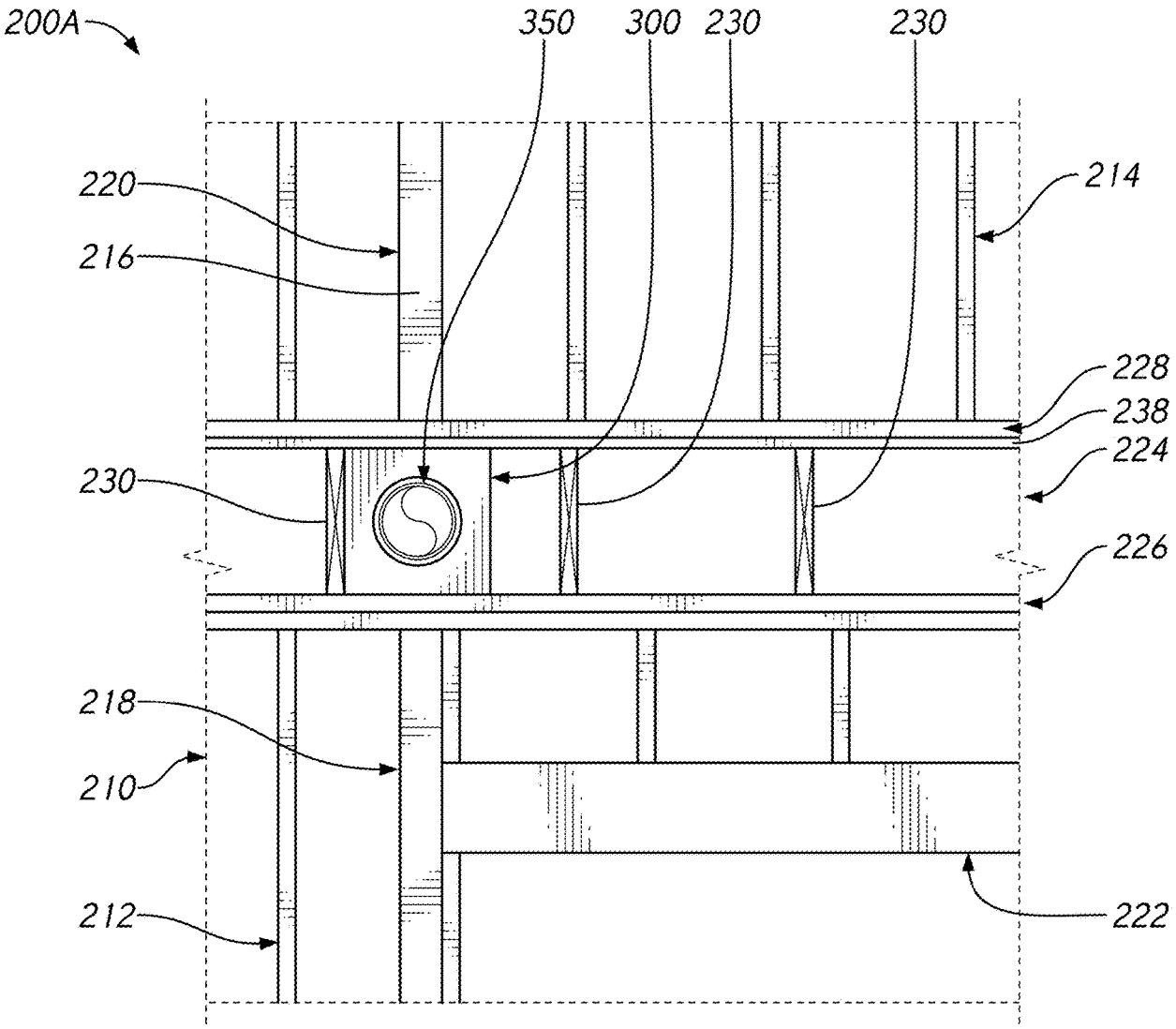
FIG. 17 illustrates a method of installing a duct support in a frame structure, where the duct support is configured to transfer a compression load. The rim of the floor assembly is omitted in order to show other components of the frame structure.

FIG. 17 illustrates a duct support assembly 200A and a method of using a duct support 300 to provide a duct exit from a frame structure 210. The method can include using the duct support 300 to transfer compression loads from the second beam portion 228 to the first beam portion 226. The duct support 300 can be configured to replace a compression element (e.g., for gravity, seismic, and/or wind loads) within the floor assembly 224 such that the duct support 300 allows compression loads to transfer and a duct to exit the frame structure 210 in the same general location. The method can include installing the duct support 300 vertically between a first post portion 218 and a second post portion 220 of a post 216 (such as a king post, gravity post, or compression post of the frame structure 210). The first post portion 218 can extend upwards towards the first beam portion 226. A portion of the side of the first post portion 218 can abut a header 222 that is positioned above a window or door opening. The second post portion 220 can extend downwards towards the second beam portion 228. The method can include installing the duct support 300 laterally between a first joist 230 and a second joist 230 of the floor assembly 224. The duct support 300 can be configured to transfer compression loads from the second post portion 220 disposed above the duct support 300 to the first post portion 218 disposed beneath the duct support 300.

Figure 18:
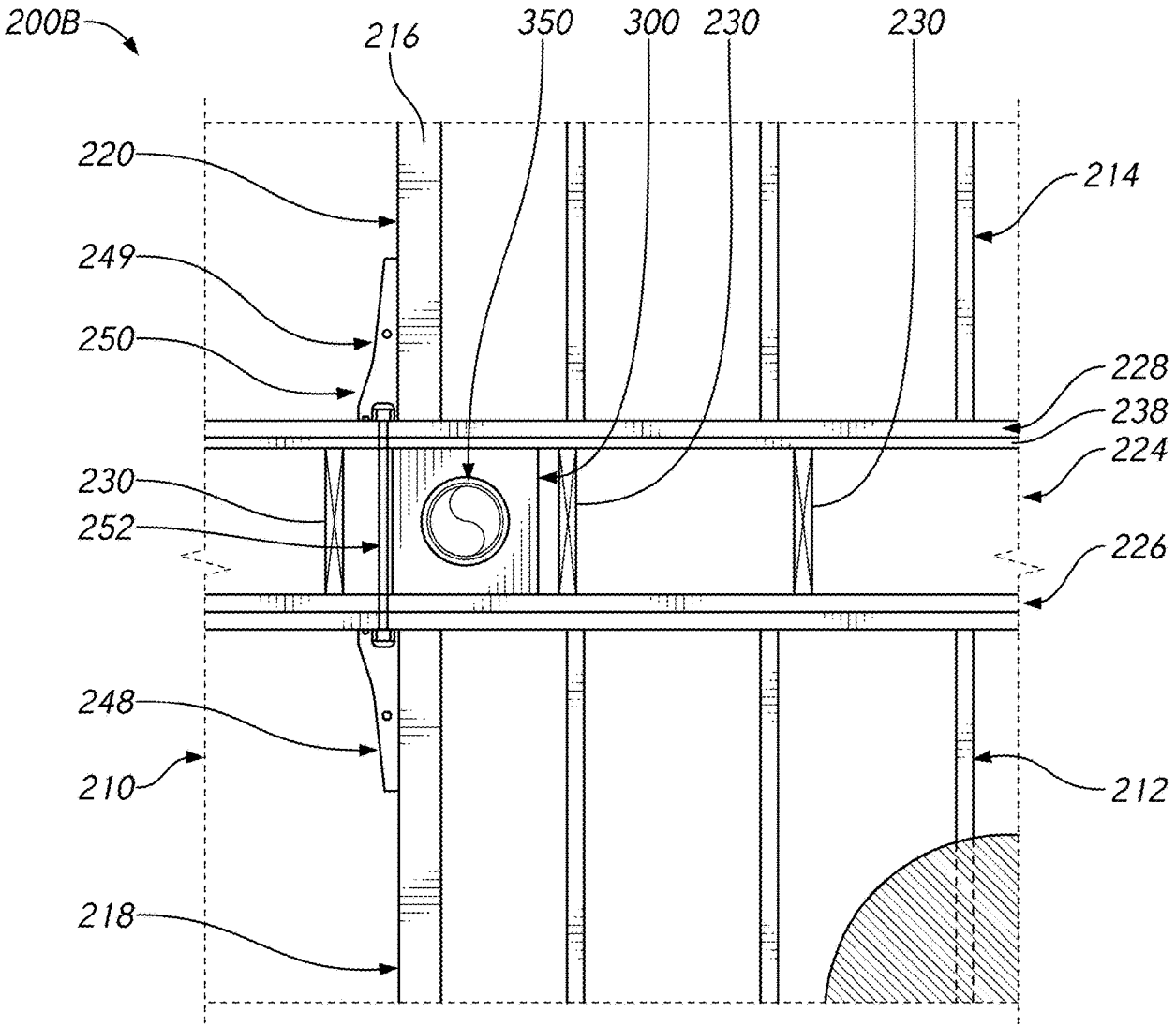
FIG. 18 illustrates a method of installing a duct support in a frame structure using a holdown assembly, where the duct support is configured to transfer a compression load. The rim of the floor assembly is omitted in order to show other components of the frame structure.

FIG. 18 illustrates another embodiment of a duct support assembly 200B and another method of using a duct support 300 to provide a duct exit from a frame structure 210. The duct support assembly 200B can have the same or similar features and/or functions as duct support assemblies 200A, 200C, 200D, 200E, 200F, except as otherwise described. For example, the duct support 300 can be configured to replace a compression element (e.g., for gravity, seismic, and/or wind loads) within the floor assembly 224 such that the duct support 300 allows compression loads to transfer and a duct to exit the frame structure 210 in the same general location. The method can include installing the duct support 300 vertically between a first post portion 218 and a second post portion 220 and laterally adjacent to a holdown assembly 250. The duct support 300 can be configured to transfer compression loads from the second post portion 220 disposed above the duct support 300 to the first post portion 218 disposed beneath the duct support 300.

The holdown assembly 250 can be configured to transfer tension loads (e.g., resist seismic and wind loads). The holdown assembly 250 can have a first end 248, a second end 249, and a rod 252 (such as an anchor rod) extending between the first end 248 and the second end 249. The first end 248 of the holdown assembly 250 can be attached to the first post portion 218. The second end 249 of the holdown assembly 250 can be attached to the second post portion 220. A tension load applied to the second end 249 of the holdown assembly 250 by the second post portion 220 can be transferred through the rod 252 to the first end 248 of the holdown assembly, and from the first end 248 of the holdown assembly 250 to the first post portion 218.

FIG. 19 illustrates another embodiment of a duct support assembly 200C and another method of using a duct support 300 to provide a duct exit from a frame structure 210. The duct support assembly 200C can have the same or similar features and/or functions as duct support assemblies 200A, 200B, 200D, 200E, 200F, except as otherwise described. The duct support 300 can be configured to replace a portion of a continuous tension tie rod and compression element (e.g., for gravity, seismic, and/or wind loads) within the floor assembly 224 such that the duct support 300 allows tension and compression loads to transfer and a duct to exit the frame structure 210 in the same general location. The method can include positioning a first post 216 and a second post 216 (such as a king post, gravity post, or compression post). The method can include positioning the duct support 300 vertically between a first post portion 218 and a second post portion 220 of one of the posts 216. The duct support 300 can be configured to transfer compression loads from the second post portion 220 disposed above the duct support 300 to the first post portion 218 disposed beneath the duct support 300.

The method can include positioning the duct support 300 vertically between a first tie rod portion 258 and a second tie rod portion 260 of a tie rod assembly 256. The method can include positioning the duct support 300 laterally between a joist 230 and a blocking element 254. The blocking element 254 can extend between the first beam portion 226 and the floor sheathing panel 238 and/or the second beam portion 228, and between a first post portion 218 and a second post portion 220 of a post 216 (such as a king post or gravity post or compression post).

The first tie rod portion 258 can extend upwards towards the first beam portion 226. The second tie rod portion 260 can extend downwards towards the second beam portion 228. The method can include connecting the first tie rod portion 258 to the duct support 300, such as by connecting the first tie rod portion 258 to a connector 266 (such as a coupler nut) extending from (e.g., welded to) a lower portion of the duct support 300 (e.g., the first spanning portion 318 and/or a first spacer 374). The method can include connecting the second tie rod portion 260 to the duct support 300, such as by connecting the second tie rod portion 260 to a connector 266 (such as a coupler nut) extending from (e.g., welded to) an upper portion of the duct support 300 (e.g., the second spanning portion 326 and/or a second spacer 376). The tie rod assembly 256 can include a coupler 262 attached to the second tie rod portion 260 and a bearing plate 264 attached to the coupler 262. The bearing plate 264 can be configured to engage an upper surface of the second beam portion 228. The second tie rod portion 260 can transfer a tension load to the connector 266 extending above the duct support 300, which can transfer the load to an upper portion of the duct support 300 (e.g., the second spanning portion 326 or a second spacer 376). The duct support 300 can transfer the load around the sides of the duct support 300 to the connector 366 extending beneath the duct support 300, which can transfer the load to the first tie rod portion 258, which can continue down to the foundation of the building.

Figure 20:
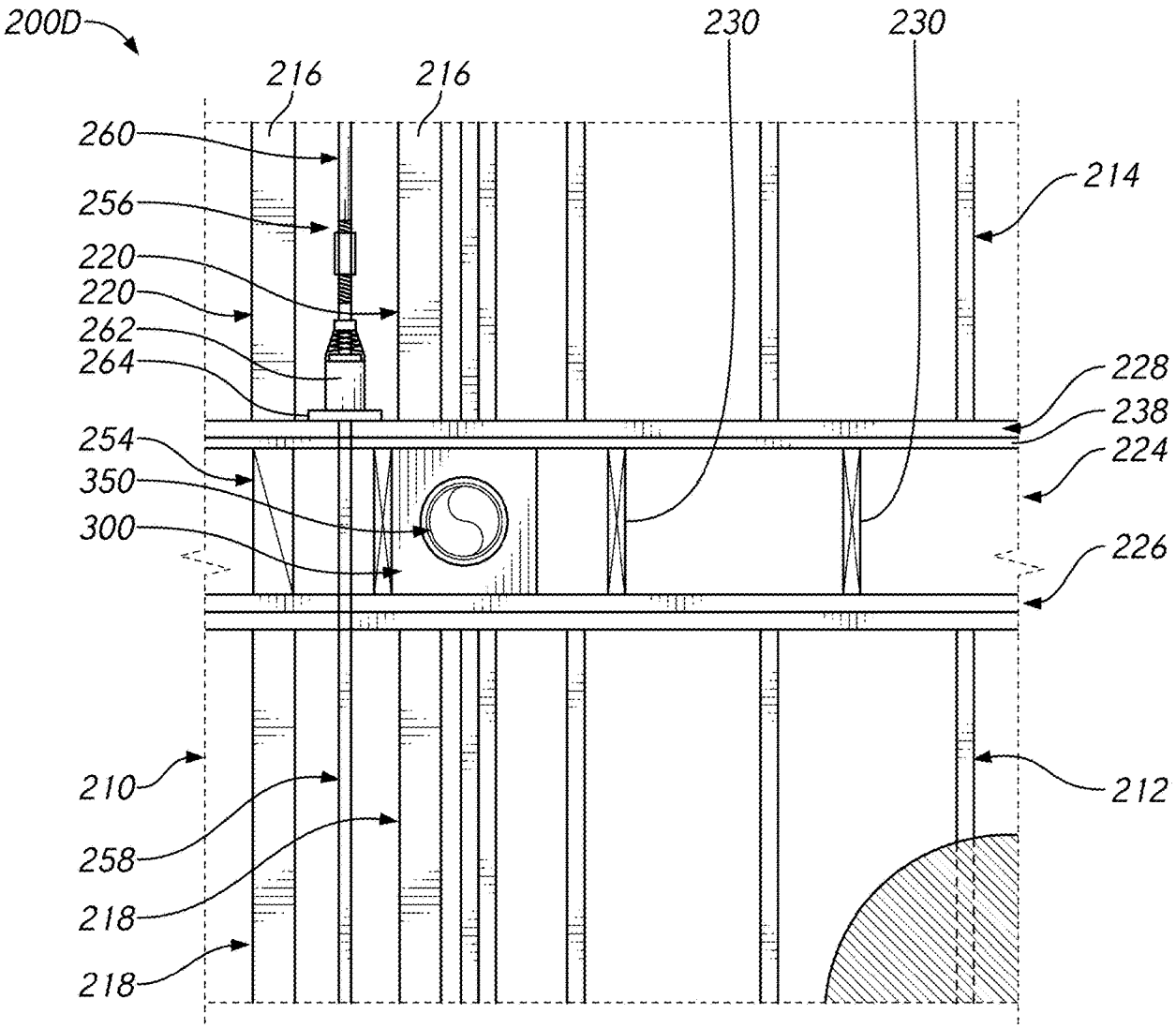
FIG. 20 illustrates a method of installing a duct support in a frame structure using a continuous tie rod assembly, where the duct support is configured to transfer a compression load. The rim of the floor assembly is omitted in order to show other components of the frame structure.

FIG. 20 illustrates another embodiment of a duct support assembly 200D and another method of using a duct support 300 to provide a duct exit from a frame structure 210. The duct support assembly 200C can have the same or similar features and/or functions as duct support assemblies 200A, 200B, 200C, 200E, 200F, except as otherwise described. The duct support 300 can be configured to replace a compression element (e.g., for gravity, seismic, and/or wind loads) within the floor assembly 224 such that the duct support 300 allows compression loads to transfer and a duct to exit the frame structure 210 in the same general location. The method can include positioning a first post 216 and a second post 216 (such as a king post, gravity post, or compression post). The method can include positioning the duct support 300 vertically between a first post portion 218 and a second post portion 220 of one of the posts 216. The duct support 300 can be configured to transfer compression loads from the second post portion 220 disposed above the duct support 300 to the first post portion 218 disposed beneath the duct support 300.

The method can include positioning the duct support 300 laterally adjacent to a continuous tie rod assembly 256. In some embodiments, as shown in FIG. 20, the continuity of the tie rod assembly 256 is not interrupted by the duct support 300. The method can include positioning the continuous tie rod assembly 256 adjacent to a post 216 (such as a king post, gravity post, or compression post). The continuous tie rod assembly 256 can be configured to transfer tension loads.

FIG. 21 illustrates another embodiment of a duct support assembly 200E and another method of using a duct support 300 to provide a duct exit from a frame structure 210. The duct support assembly 200E can have the same or similar features and/or functions as duct support assemblies 200A, 200B, 200C, 200D, 200F, except as otherwise described. The duct support 300 can be configured to replace a portion of a continuous tension tie rod within the floor assembly 224 such that the duct support 300 allows tension loads to transfer and a duct to exit the frame structure 210 in the same general location. The method can include positioning the duct support 300 vertically between a first tie rod portion 258 and a second tie rod portion 260 of a tie rod assembly 256. In some embodiments, the duct support 300 is not also positioned vertically between a first post portion 218 and a second post portion 220. The method can include positioning the duct support 300 adjacent to a post 216 (such as a king post, gravity post, or compression post). As previously described, the second tie rod portion 260 can transfer a tension load to the connector 266 extending above the duct support 300, which can transfer the load to an upper portion of the duct support 300 (e.g., the second spanning portion 326 or a second spacer 376). The duct support 300 can transfer the load around the sides of the duct support 300 to the connector 366 extending beneath the duct support 300, which can transfer the load to the first tie rod portion 258, which can continue down to the foundation of the building.

FIG. 22 illustrates another embodiment of a duct support assembly 200F and another method of using a duct support 300 to provide a duct exit from a frame structure 210. The duct support assembly 200F can have the same or similar features and/or functions as duct support assemblies 200A, 200B, 200C, 200D, 200E, except as otherwise described. The duct support 300 can be configured to replace tension and compression elements (e.g., for gravity, seismic, and/or wind loads) within the floor assembly 224 such that the duct support 300 allows tension and compression loads to transfer and a duct to exit the frame structure 210 in the same general location. The method can include attaching (e.g., welding) a connector 266 (such as a coupler nut) to a lower portion of the duct support 300 (e.g., the first spanning portion 318 and/or a first spacer 374). The method can include attaching (e.g., welding) a connector 266 (such as a coupler nut) to an upper portion of the duct support 300 (e.g., the second spanning portion 326 and/or a second spacer 376).

The method can include positioning the duct support 300 vertically between a first post portion 218 and a second post portion 220 of a post 216 (such as a king post, gravity post, or compression post) and vertically between a first end 248 and a second end 249 of a holdown assembly 250. The duct support 300 can be configured to transfer compression loads from the second post portion 220 disposed above the duct support 300 to the first post portion 218 disposed beneath the duct support 300.

The method can include attaching the first end 248 of the holdown assembly 250 to the first post portion 218 and attaching the second end 249 of the holdown assembly 250 to the second post portion 220. The method can include attaching the first end 248 of the holdown assembly 250 to the connector 266 extending from the lower portion of the duct support 300 (e.g., the first spanning portion 318 and/or a first spacer 374). The method can include attaching the second end 249 of the holdown assembly 250 to the connector 266 extending from the upper portion of the duct support 300 (e.g., the second spanning portion 326 and/or a second spacer 376).

The holdown assembly 250 can be configured to transfer tension loads (e.g., resist seismic and wind loads). A tension load applied to the second end 249 of the holdown assembly 250 by the second post portion 220 can be transferred to the first end 248 of the holdown assembly and from the first end 248 of the holdown assembly 250 to the first post portion 218. The connector 266 that is connected to the upper portion of the duct support 300 can allow the tension load to transfer through the duct support 300 and the connector 266 that is attached to the lower portion of the duct support 300 can facilitate the transfer of the tension load out of the duct support 300 to the first end 248 of the holdown assembly 250.

From the foregoing description, it will be appreciated that inventive duct support assemblies and methods of using a duct support assembly are disclosed. While several components, techniques and aspects have been described with a certain degree of particularity, it is manifest that many changes can be made in the specific designs, constructions and methodology herein above described without departing from the spirit and scope of this disclosure.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount. If the stated amount is 0 (e.g., none, having no), the above recited ranges can be specific ranges, and not within a particular % of the value. For example, within less than or equal to 10 wt./vol. % of, within less than or equal to 5 wt./vol. % of, within less than or equal to 1 wt./vol. % of, within less than or equal to 0.1 wt./vol. % of, and within less than or equal to 0.01 wt./vol. % of the stated amount.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A duct support assembly comprising:

a frame structure comprising a floor assembly, a first wall frame, and a second wall frame, the first wall frame comprising a first beam portion and the second wall frame comprising a second beam portion; and a duct support configured to be installed in the floor assembly between the first beam portion and the second beam portion and to provide a duct exit from the frame structure, the duct support comprising:

a first main brace portion;

a second main brace portion;

a first spanning portion and a second spanning portion, each of the spanning portions extending between the first main brace portion and the second main brace portion; and an opening defining a passage configured to receive a duct;

wherein the duct support is configured such that when the duct support is installed in the frame structure and a load of at least 400 lbs per square inch is applied to the second spanning portion, the duct support transfers the load to the first beam portion.

2. The duct support assembly of claim 1, wherein each of the main brace portions extends from the first spanning portion to the second spanning portion.

3. The duct support assembly of claim 1, wherein the duct support is configured to withstand the load without failing.

4. The duct support assembly of claim 1, wherein when the duct support is installed in the frame structure, the passage allows a duct to extend through the passage to an outer wall of a building.

5. The duct support assembly of claim 1, wherein the duct support is configured such that compression loads applied to the second spanning portion transfer to the first spanning portion.

6. The duct support assembly of claim 1, wherein the duct support is configured such that tension loads applied to the second spanning portion transfer to the first spanning portion.

7. The duct support assembly of claim 1, wherein the first main brace portion defines a first planar surface and the second main brace portion defines a second planar surface, and wherein the first planar surface and the second planar surface are coplanar.

8. The duct support assembly of claim 1, wherein the duct support further comprises a plurality of stiffener sections configured to increase a load transfer capacity of the duct support.

9. The duct support assembly of claim 8, wherein the plurality of stiffener sections comprises a first stiffener section coupled to an inner surface of the first main brace portion and a second stiffener section coupled to an inner surface of the second main brace portion.

10. The duct support assembly of claim 8, wherein the plurality of stiffener sections comprises a vertical stiffener section extending between the first spanning portion and the second spanning portion.

11. The duct support assembly of claim 10, wherein the plurality of stiffener sections comprises an angled stiffener section extending between the vertical stiffener section and an inner surface of the second spanning portion.

12. The duct support assembly of claim 1, wherein the duct support further comprises a first connector attached to the first spanning portion and a second connector attached to the second spanning portion, each of the first connector and the second connector being configured to couple to a tie rod assembly.

* * * * *